US005342184A

United States Patent [19]

Comparin et al.

[11] Patent Number: 5,342,184

[45] Date of Patent: Aug. 30, 1994

[54] SCROLL MACHINE SOUND ATTENUATION

[75] Inventors: Robert J. Comparin, Troy; Harry B. Clendenin, Sidney; Kent E. Logan, Englewood; Mark Bass; Steven C. Fairbanks, both of Sidney; Jean-Luc Caillat, Dayton, all of Ohio

[73] Assignee: Copeland Corporation, Sidney, Ohio

[21] Appl. No.: 57,302

[22] Filed: May 4, 1993

[51] Int. Cl.[5] ..... F01C 1/04; B23P 15/00

[52] U.S. Cl. ..... 418/55.2; 418/55.3; 418/55.5; 29/888.022; 464/102

[58] Field of Search ..... 418/55.2, 55.3, 55.5, 418/57; 29/888.022; 464/102

[56] References Cited

U.S. PATENT DOCUMENTS

| | | | |
|---|---|---|---|
| 4,082,484 | 4/1978 | McCullough | 418/57 |
| 4,551,078 | 11/1985 | Hiraga | 418/57 |
| 4,579,512 | 4/1986 | Shiibayashi et al. | 418/178 |
| 4,608,001 | 8/1986 | Sugimoto et al. | 418/57 |
| 4,609,334 | 9/1986 | Muir et al. | 418/55.2 |
| 4,626,179 | 12/1986 | Terauchi | 418/55.5 |
| 4,753,582 | 6/1988 | Morishita et al. | 418/57 |
| 4,773,835 | 9/1988 | Machida et al. | 418/55.2 |
| 4,840,549 | 6/1989 | Morishita et al. | 418/57 |
| 4,904,170 | 2/1990 | Suefuji et al. | 418/55.2 |
| 5,188,521 | 2/1993 | Kawahara et al. | 418/55.3 |
| 5,193,992 | 3/1993 | Terauchi | 418/55.5 |

FOREIGN PATENT DOCUMENTS

| | | | |
|---|---|---|---|
| 59-12187 | 1/1984 | Japan | 418/55.2 |
| 62-17383 | 1/1987 | Japan | 418/55.3 |
| 1-53087 | 3/1989 | Japan | 418/57 |

*Primary Examiner*—John J. Vrablik

*Attorney, Agent, or Firm*—Harness, Dickey & Pierce

[57] ABSTRACT

A scroll machine designed to provide an unbalanced loading of the orbiting scroll and anti-rotation coupling in a direction which adds to the moment caused by contact forces between the scroll wraps during normal operation. The loading decreases the sound level of the machine and is achieved through the use of unbalanced flank gas leakage forces and flank contact forces, which are created by providing a targeted initial swing radius bias and/or a generating radius bias to either one or both of the scroll wraps. The generating radius biasing can be singular or plural on a given scroll wrap set. A number of different techniques for obtaining such biasing are disclosed.

115 Claims, 22 Drawing Sheets

Zone 2

Zone 3

FIG. 25.
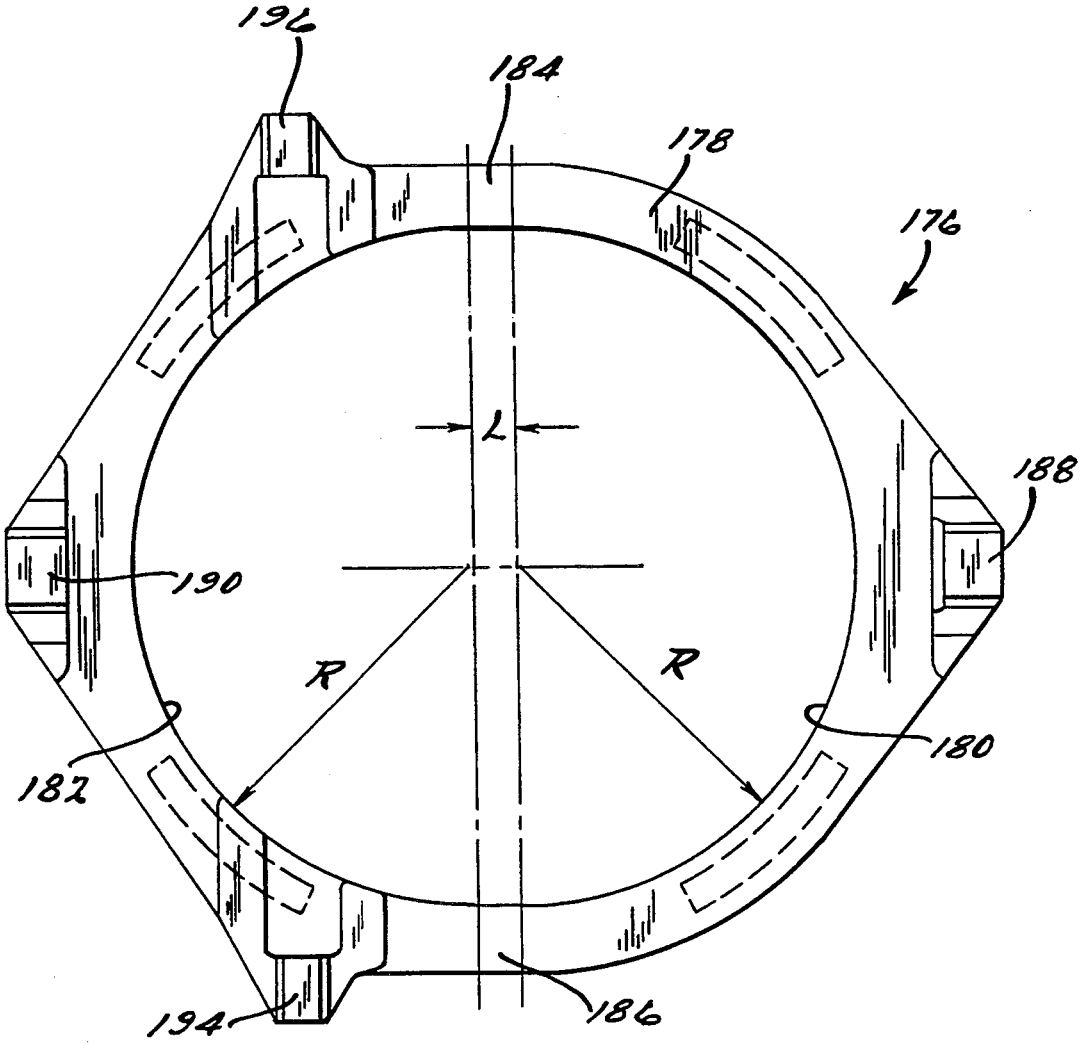
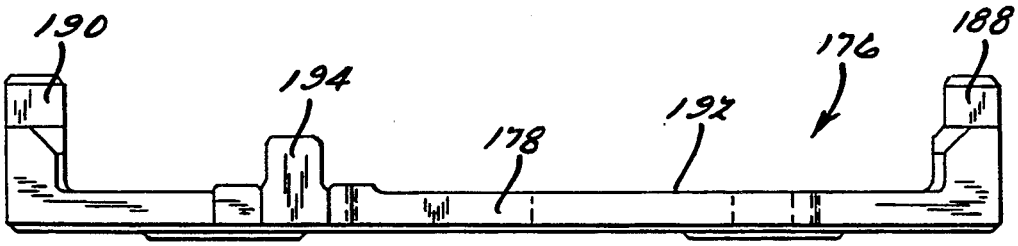
FIG. 26.

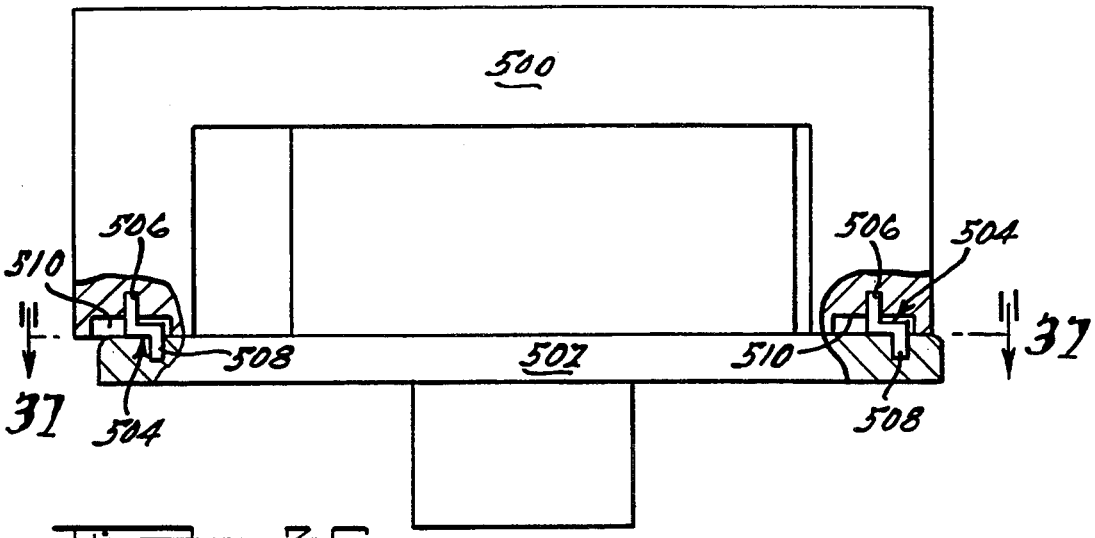
FIG. 36.
FIG. 38.
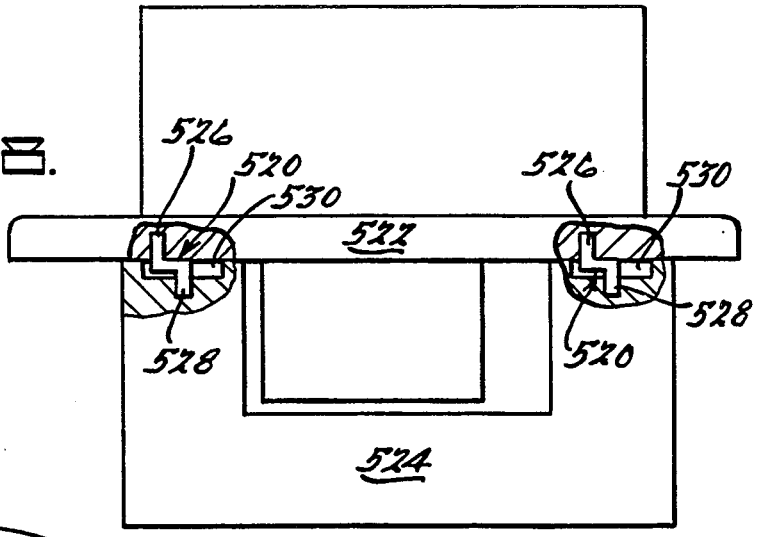
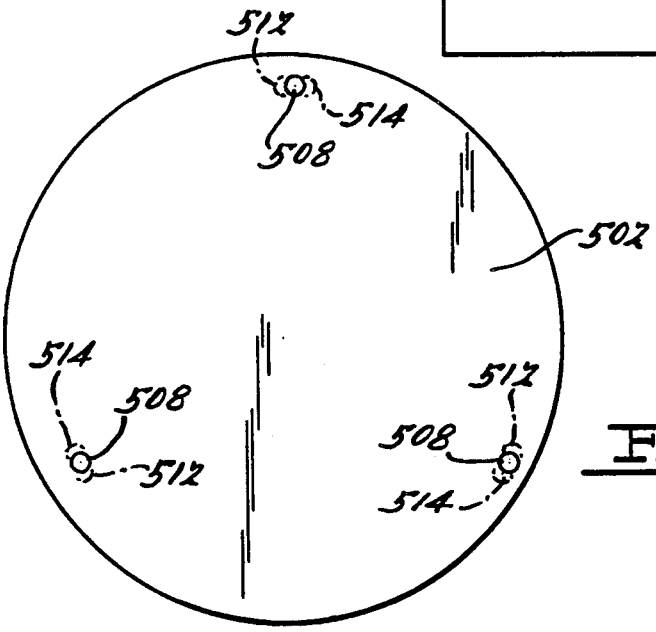
FIG. 37.

SCROLL MACHINE SOUND ATTENUATION

This invention relates to scroll machines and more particularly to a novel method and apparatus for attenuating noise in such machines which utilize an Oldham coupling or equivalent device to prevent relative rotation of the scroll members.

BACKGROUND AND SUMMARY OF THE INVENTION

Although the present invention is believed to be applicable to different types of scroll machines it is disclosed herein embodied in a refrigerant compressor for use in air conditioning, heat pump and refrigerating systems, such as that disclosed in applicants' assignee's U.S. Letters Pat. No. 5,102,316, the disclosure of which is hereby incorporated herein by reference.

In the marketplace there is an increasing demand for much quieter machinery than was hitherto acceptable, and this is especially true in the case of air conditioning and heat pump systems. There are a number of identified sources of sound in a scroll compressor, many of which are relatively easily cured. A recently discovered source of sound which does not lend itself to easy cure, however, concerns the mechanical impact noise or rattle which is caused by vibration of the orbiting scroll member and Oldham coupling under certain operating conditions, i.e., under lighter load conditions when there is insufficient loading of the orbiting scroll and Oldham coupling to prevent force reversals which can cause the keys on the Oldham coupling to impact noisily on the sides of the slots in which they are disposed.

Even though scroll compressors have been in commercial production for many years now, it has been observed that some compressors are significantly more quiet than others. In studying this phenomenon it has been determined that the variance in the noise in question is in large part due to the variance in physical dimensions resulting from the difficulty in closely controlling manufacturing tolerances to a precise degree. The problem has been compounded by a lack of understanding of exactly what specific dimensions and tolerances are in fact critical to noise attenuation in such a machine.

Conventional wisdom dictates that each of the mating scroll wraps has a true involute profile which is generated from the exact same size and shape generating element and the same initial swing radius. In other words, there should be zero generating radius bias and zero initial swing radius bias. In addition, the mating scroll wraps should be arranged at exactly 180 degrees with respect to one another. In a theoretically perfect machine built to such absolute dimensions, the wraps would be fully conjugate and loading would be symmetrical. This is a "nominal" design as discussed herein. Because it is physically impossible to manufacture anything to an absolute dimension on a repeating basis, the challenge is to know where to target nominal dimensions and how to specify tolerances in such a way that the desired goal will be obtained.

The present invention resides in the discovery of what is truly critical to the design of a quiet scroll compressor (insofar as the present noise source is concerned), how to specify the critical relationships of the parts, and where to focus the unavoidable tolerances so that the desired overall result will be obtained, without sacrificing efficiency and without increasing production cost.

Applicants' have discovered that noise associated with the vibration of the orbiting scroll and Oldham coupling in a scroll compressor can be related to the moment load about the center of the orbiting scroll. When this moment is sufficiently large, noise problems associated with the vibration of the orbiting scroll can be avoided, but when this moment becomes too small, significant noise problems will occur. The moment on the scroll is a function of the operating condition and compressor design. The objective of this invention is to provide for optimal moment loading by biasing flank contact through the proper selection of two compressor design parameters, i.e., the initial swing radius bias and the generating radius bias. These two parameters alter the moment loading on the orbiting scroll by changing the scroll contact forces (flank forces) and by introducing additional gas forces (leakage forces). Several unique methods of fabricating scroll compressors to avoid the problems of the prior art and achieve the objects of the invention are disclosed, as well as several novel physical designs for achieving the same result.

The preferred approach herein is to increase the moment loading on the orbiting scroll and Oldham coupling using the flank loads while minimizing the contribution from adverse leakage forces. One preferred way of implementing this approach is to provide a moderate positive initial swing radius bias combined with a small negative generating radius bias. Here the positive initial swing radius bias provides the increase in moment due to flank forces and the negative generating radius bias minimizes leakage forces. The advantages of this implementation are: The initial swing radius bias is the primary parameter and is more controllable in manufacturing than the generating radius bias; the initial swing radius bias can be introduced in a number of ways, whereas the generating radius bias must be machined into the scrolls; the negative generating radius bias will reduce the leakage at suction which is important for reducing the adverse effects of leakage on capacity. A small generating radius bias combined with flank flexibility leads to better load sharing, thereby reducing problems associated with large localized contact loads.

Another preferred way of implementing this approach is to provide a large positive generating radius bias in combination with a small negative initial swing radius bias. This approach is more general and if multiple generating radii are used on a single wrap it is possible to use both flank forces and leakage forces to load the scroll. Using this multiple generating radii approach it is also possible to avoid problems associated with outer wrap interference at suction closing, i.e., "suction bump".

Other features and advantages of the embodiments of the present invention include the provision of a scroll machine design and method of fabricating such a machine which provides significant and consistent improvements in sound attenuation without sacrificing efficiency, simplicity in design and cost of manufacture.

These and other features and advantages of the present invention will become apparent from the following description and the appended claims, taken in conjunction with the accompanying drawings.

BRIEF DESCRIPTION OF THE DRAWINGS

FIG. 3 is a blow up of the inner portion of FIG. 2 used to clarify the lines of action of the forces;

FIG. 25 is a top plan view of the Oldham coupling incorporated in the refrigeration compressor shown in FIGS. 22–24;

FIG. 26 is a side elevational view of the Oldham coupling of FIG. 25;

FIG. 36 is a schematic view of a scroll machine in which relative rotation of the scroll members is prevented by use of a plurality of small cranks extending between the scroll members;

FIG. 37 is a sectional view taken along line 37—37 in FIG. 36; and

FIG. 38 is a view similar to FIG. 36 but showing an arrangement where the cranks operate between the orbiting scroll member and the main bearing housing.

DESCRIPTION OF THE PREFERRED EMBODIMENTS

The general principles of scroll compressor design and operation are now well known in the art. The description of the present invention therefore will not include extensive discussion about the basics, but will deal with applicants' nomenclature and the nature of applicants' discoveries.

BACKGROUND

Figure 1:
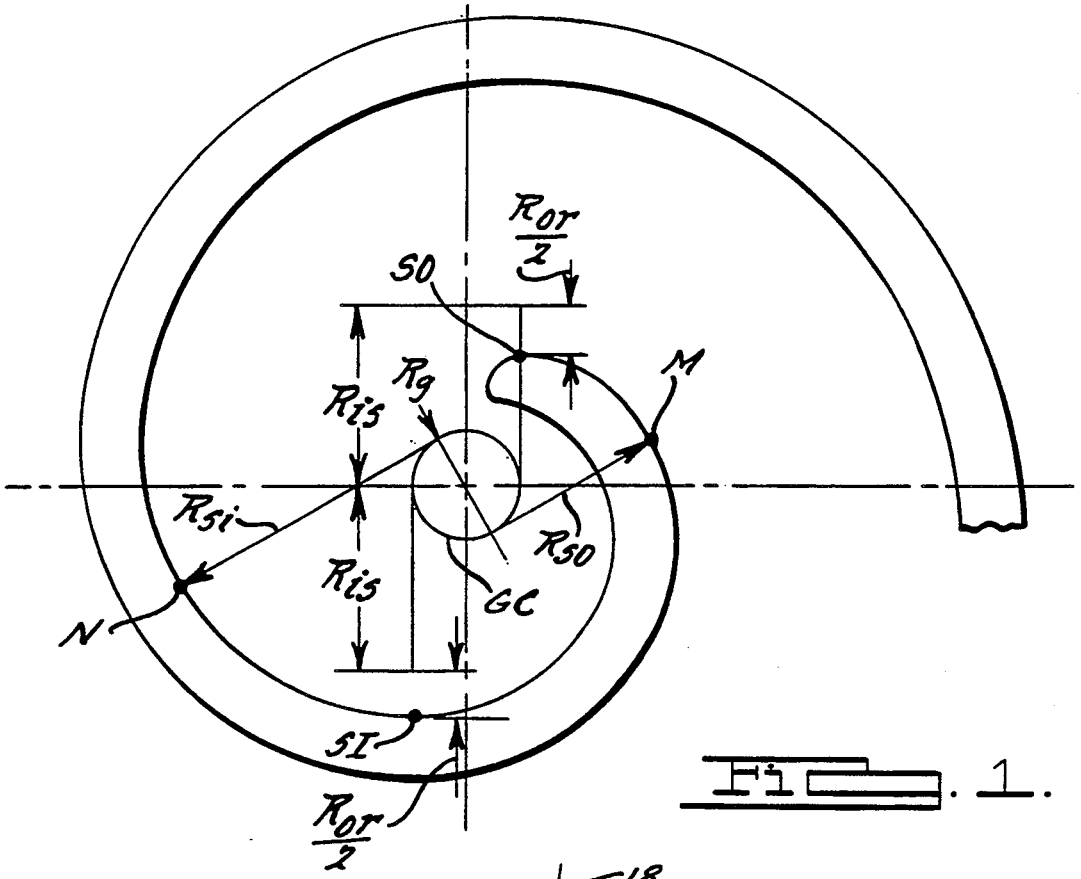
FIG. 1 is a diagrammatic illustration of the inner portion of a single scroll wrap used to define appropriate scroll geometry.

FIG. 1 illustrates the nomenclature (as used herein) and geometry of the inner end of a scroll vane or wrap of the type forming the subject matter of the present invention. Nominally, the profile of each face or flank is the involute of a generating circle GC having a generating radius $R_g$, with SO being the start of the involute working surface (compression wrap) on the outer flank and SI being the start of the involute working surface on the inner flank. $R_{is}$ is the initial swing radius and represents an arbitrarily designated radius used to establish the position of the center line of the flanks at the start of the working wrap, thus the starting position of each working wrap flank. $R_{or}$ is the orbit radius defining the size of the relative circular orbit of the two mating scroll members. A point M on the outer flank is defined by the outer swing radius $R_{so}$, which is the length of the line segment which is tangent to generating circle GC and directed to M. Similarly, a point N on the inner flank can be defined by an inner swing radius $R_{SI}$. The two swing radii, and hence the entire scroll wrap, including the orbiting radius $R_{or}$, can be completely defined by the generating radius $R_g$, the initial swing radius $R_{is}$, and the thickness of each wrap.

Figure 2:
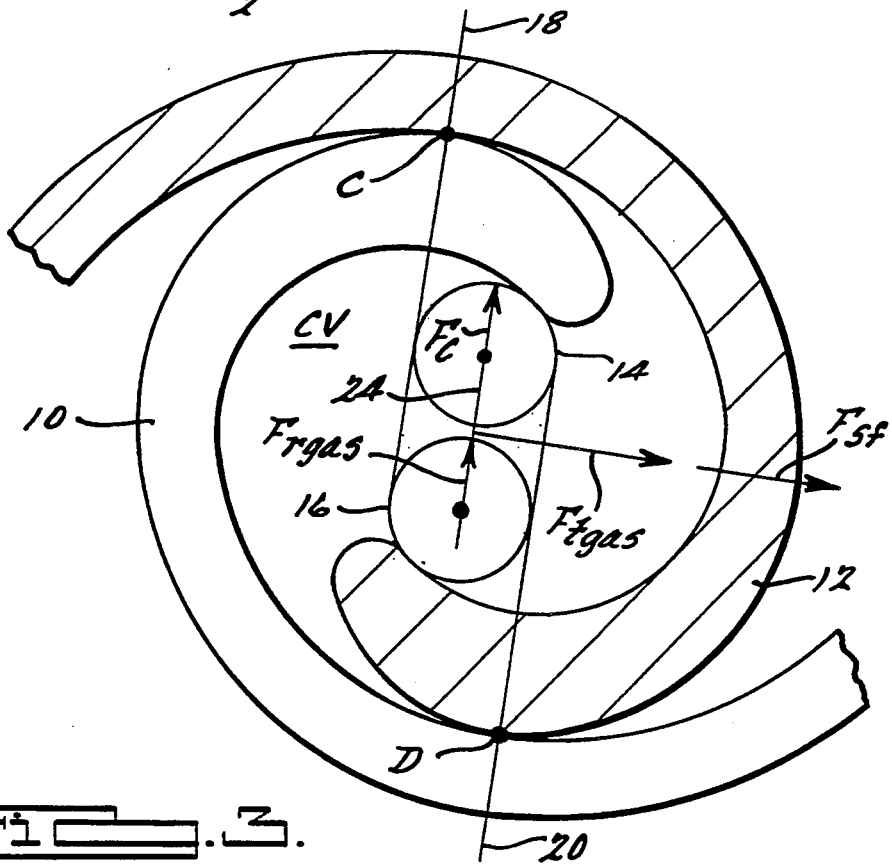
FIG. 2 is an illustration of a mating scroll pair in contact defining the forces acting on the members in the nominal case.
Figure 2:
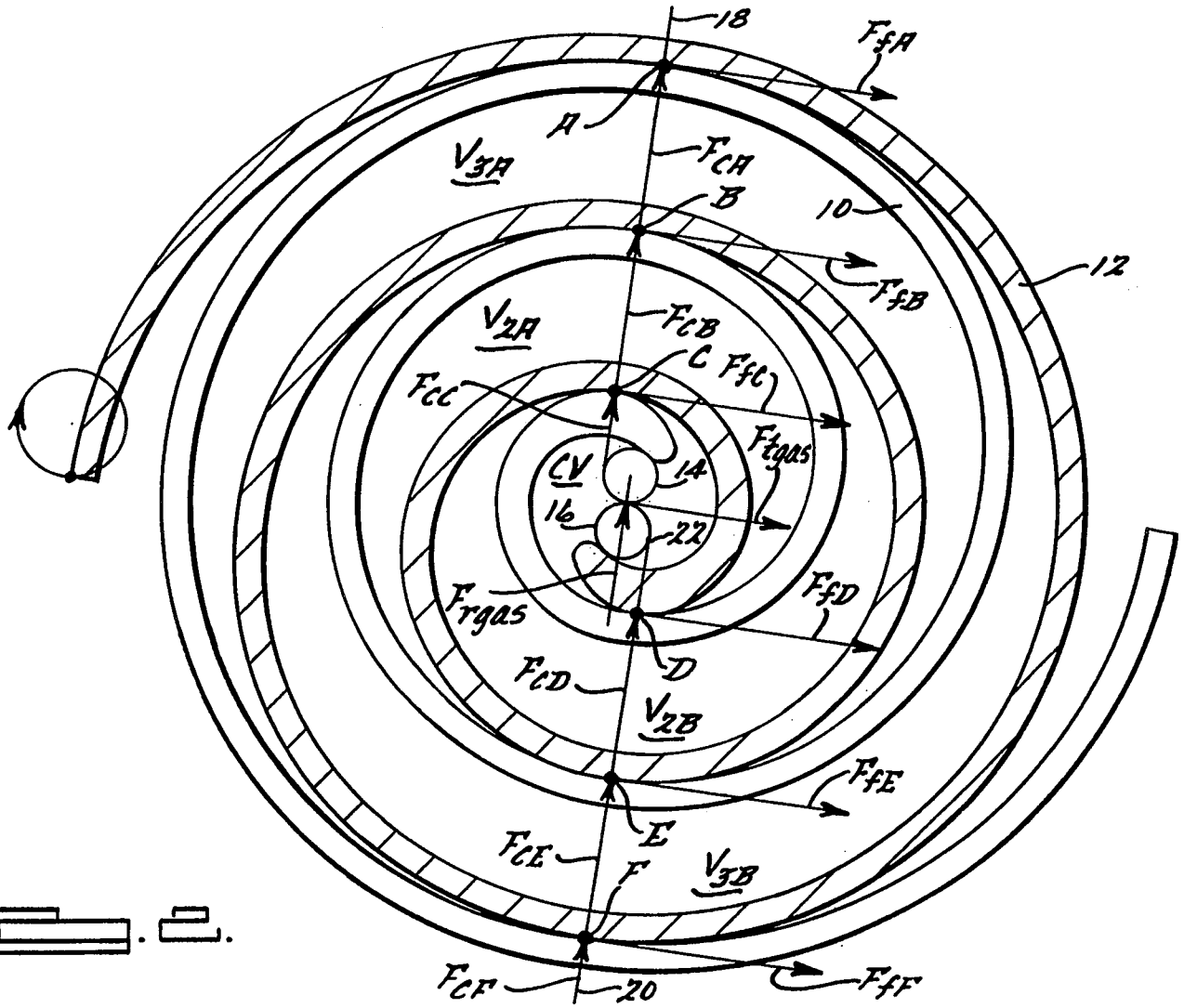

Illustrated in FIG. 2 are the basic forces acting on a scroll compressor of nominal design. It comprises a fixed scroll 10 and an orbiting scroll 12, both involutes of generating circles 14 and 16, respectively, and orientated 180 degrees from one another. For the specific point in the orbit shown, there are six points of flank contact which are indicated by points A through F. At some orbit positions there will only be four contact points but the following discussion still applies. Seal line 18 passes through contact points A through C and is tangent to generating circle 14, and seal line 20 passes through contact points D through F and is tangent to generating circle 16. The two seal lines are parallel and define the contact points which define the compression pockets. The pockets shown include the central volume CV, the two intermediate pockets $V_{2A}$ and $V_{2B}$, and the two suction pockets $V_{3A}$ and $V_{3B}$. For the nominal case the pressure in $V_{2A}$ is the same as in $V_{2B}$ and similarly the pressure in $V_{3A}$ is the same as in $V_{3B}$. The most common type of operating condition is when the discharge pressure is higher than that provided by the built-in pressure ratio of the machine, or in other words, the scrolls are "undercompressing". Therefore, pressure in CV will be greater than in $V_{2A}$, $V_{2B}$ and both will be greater than $V_{3A}$, $V_{3B}$.

The pressure differences between the different pockets creates a gas force that acts on the orbiting scroll. This force can be separated into two components: the radial gas force $F_{rgas}$ and the tangential gas force $F_{tgas}$. $F_{rgas}$ is parallel to the two seal lines and is directed along the line of centers 24 between the two generating circles (FIG. 3). This force does not create a moment on the orbiting scroll but does tend to separate the scrolls, thereby reducing the contact forces. $F_{tgas}$ is perpendicular to the line of centers 24 between the generating circles and because of the symmetry in the system acts through the midpoint between the two centers. This force $F_{tgas}$, creates a clockwise moment about the center of the orbiting scroll with a moment arm equal to half of the orbit radius (half the distance between the two generating circles).

The motion of the orbiting scroll creates an inertia force which loads the orbiting scroll against the fixed scroll and works against $F_{rgas}$. The difference between these two forces (the inertia force generally being greater than the gas force) results in the contact forces $F_{CA}$–$F_{CF}$ at each of the contact points A–F. In general $F_{CA}$ will be different from $F_{CB}$ and from $F_{CC}$ but because of symmetry $F_{CA}$ will be equal to $F_{CF}$, $F_{CB}$ will be equal to $F_{CE}$, and $F_{CC}$ will be equal to $F_{CD}$. As a result, the resultant contact force will be parallel to the seal lines and along the line of centers between the two generating circles. Like $F_{rgas}$, the resultant contact force $F_C$ does not create a moment load on the orbiting scroll.

In addition to the contact forces, there will also be friction forces $F_{fA}$–$F_{fF}$ acting at each of the contact points A–F which are perpendicular to the contact forces. Because of symmetry, the resultant friction forces $F_{sf}$ will act through the same point and in the same direction as $F_{tgas}$ (FIG. 3). Therefore, in the nominal case, the friction forces will also create a clockwise moment about the center of the orbiting scroll.

The moment created by the two forces $F_{tgas}$ and $F_{sf}$ represents the basic moment load on the orbiting scroll in the nominal compressor. The total moment will vary with conditions because the gas loads change. For cases where the moment is sufficiently large, no sound problems will occur. When this moment is too small, however, noise problems will occur and the need for the present invention arises.

Bias Definitions

An initial swing radius bias, $dR_{is}$, represents a difference in the radial position of the starting point of the involute working profile of the orbiting scroll relative to the fixed scroll. A generating radius bias $dR_g$, represents the difference in the rate of growth of the orbiting scroll relative to the fixed scroll.

In the absence of a $dR_{is}$ or a $dR_g$, the flank contact between the two scrolls will be symmetrical as shown in FIG. 2. When a swing radius bias is introduced the symmetry is lost and the contact occurs on only one side of the geometric center of the scroll. As a result, the lines of action of the resultant flank contact force and the resultant flank friction force change. In addition, leakage is introduced on the side where contact is lost which results in a change in the gas forces.

Initial Swing Radius Bias

Figure 4:
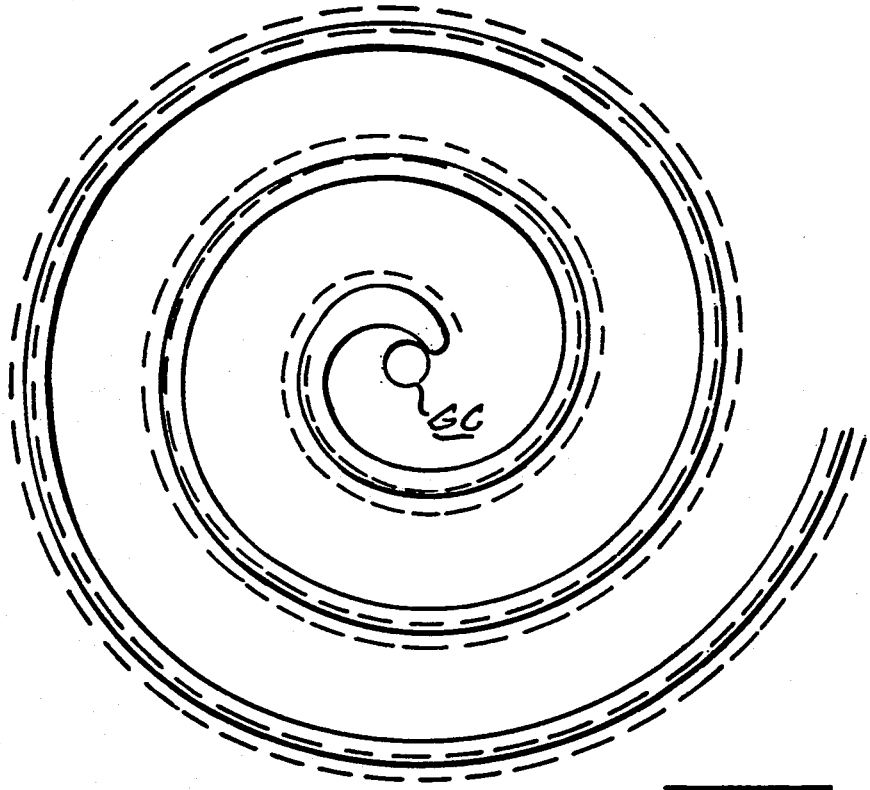
FIGS. 4 and 5 represent diagrammatically in an exaggerated manner, the effect, shown in dashed lines, of positive initial swing radius error and negative initial swing radius error, respectively.
Figure 5:
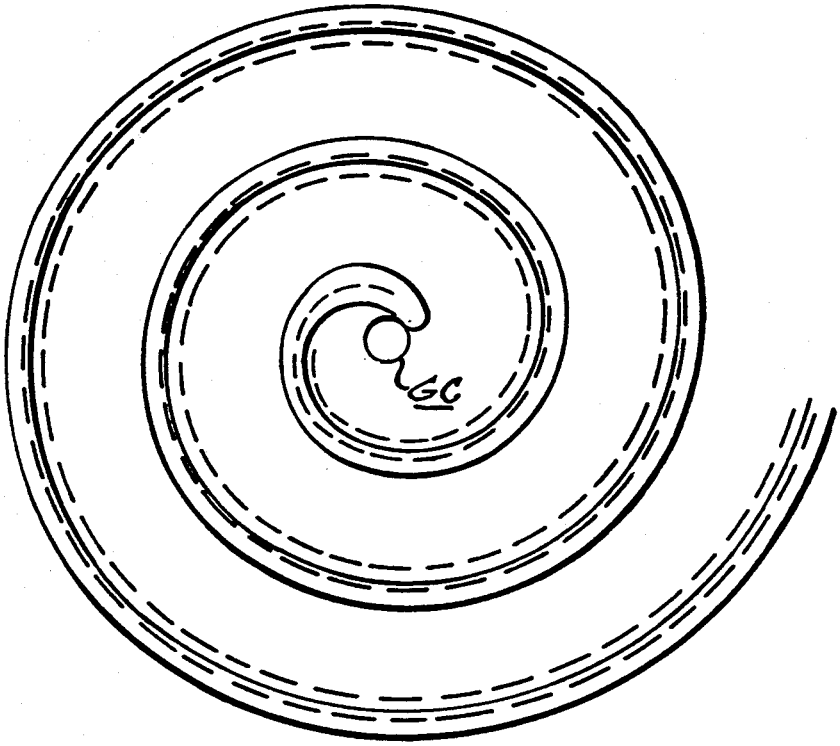

A positive initial swing radius bias, $dR_{is}$, as used herein, means that the fixed scroll has a greater initial swing radius $R_{is}$ than the orbiting scroll, and this is achieved by introducing an $R_{is}$ error to either or both of the wraps. As used herein, error or deviation means the difference from the nominal value. Thus, the fixed scroll could have a zero or negative $R_{is}$ error and the orbiting scroll a more negative $R_{is}$ error, or the fixed scroll could have a positive $R_{is}$ error and the orbiting scroll a zero or less positive $R_{is}$ error. Similary, a negative initial swing radius bias $dR_{is}$ can be conversely obtained. FIGS. 4 and 5 illustrate the effect (shown in dashed lines) of a positive $R_{is}$ error (FIG. 4) and a negative $R_{is}$ error (FIG. 5).

Figure 6:
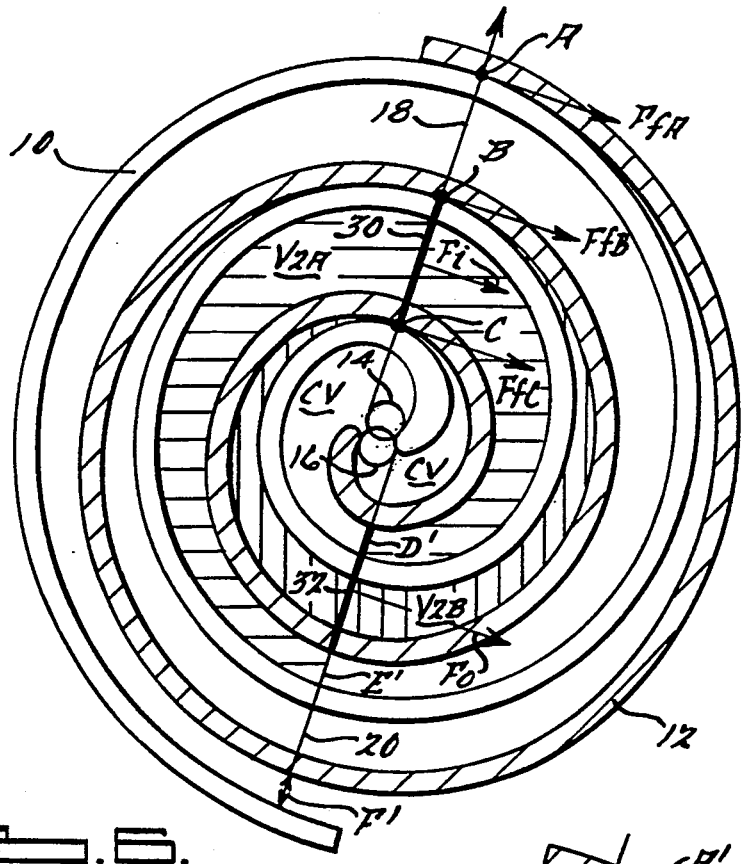
FIG. 6 illustrates diagrammatically in an exaggerated manner, the effect on a scroll set of positive initial swing radius bias produced by a negative initial swing radius error on the orbiting scroll.
Figure 7:
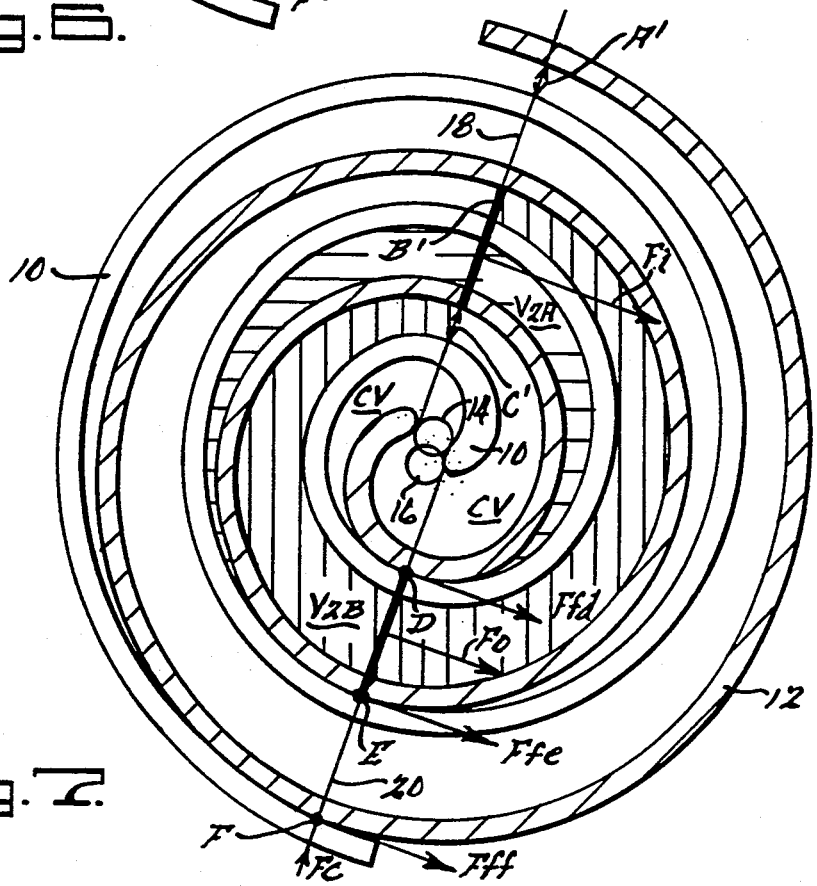
FIG. 7 illustrates diagrammatically in an exaggerated manner, the effect on a scroll set having a negative initial swing radius bias by providing a positive initial swing radius error on the orbiting scroll.

The effect of initial swing radius bias on a scroll set having zero $R_g$ is shown in FIGS. 6 and 7. In FIG. 6 there is shown a scroll set having a positive $dR_{is}$ obtained by providing a negative $R_{is}$ error on the orbiting scroll, and in FIG. 7 a set having a negative $dR_{is}$ obtained by providing a positive $R_{is}$ error on the orbiting scroll. The fixed scroll has zero $R_{is}$ error. Thus, in a positive bias machine (FIG. 6) flank contact remains effective at points A–C whereas previous contact points D–F (FIG. 2) are now clearances D′–F′. These clearances mean that there is no longer any balancing contact forces or friction forces at points D–F. As a consequence, the resultant contact force $F_c$ will now create a clockwise moment about the center of the orbiting scroll with a moment arm equal to the generating radius. The resultant friction force will shift from the midpoint between the two generating circles to some point on the seal line between points A and C. The exact location will depend on the load sharing between the contact points which is a function of the relative stiffnesses of the flanks. The moment associated with the friction force increases dramatically, resulting in a much larger clockwise friction moment than for the nominal case. Because the nominal gas moment is in the clockwise direction, for that particular winding of the wrap, the change in the mechanical forces resulting from a positive $dR_{is}$ results in an increase in the moment load on the orbiting scroll.

Conversely, for a negative bias machine (FIG. 7) flank contact remains effective at points D–F, with previous contact points A–C becoming clearances A′–C′. A similar change in the resultant contact and friction forces occurs but the lines of action for this case are such that the two mechanical forces create a counter clockwise moment on the orbiting scroll. Because the nominal gas moment is still in the clockwise direction, the change in the mechanical forces resulting from a negative $dR_{is}$ results in a decrease in the favorable moment load on the orbiting scroll.

In addition to changing the moments due to changes in the mechanical forces, biasing the initial swing radius also changes the moments due to changes in the gas forces resulting from leakage of gas pressure through the now created clearances A'-C' (FIG. 7) or D'-F' (FIG. 6). The gas moment associated with the compression process arises from the pressure differences between the different types of pockets (i.e., CV versus $V_2$ and $V_2$ versus $V_3$). In the absence of a $dR_{is}$ or $dR_g$, the pressure in a given pair of pockets will by symmetrical (i.e., pressure in $V_{2A}$=pressure in $V_{2B}$) as noted earlier, however, the loss of flank contact associated with $dR_{is}$ will allow communication between pockets with different pressure so leakage will occur from higher pressure pockets to lower pressure pockets. The leakage will not be uniform because clearance is introduced in only half the pockets so the pressure symmetry in the compressor will be lost. The pressure difference between like pockets ($V_{2A}$ and $V_{2B}$) introduces additional gas forces which act on the orbiting scroll. The moments associated with these additional gas forces can act in the same direction as the moment associated with the compression process or in the opposite direction, depending on the type of bias. In addition, the magnitude of the gas moment will depend on the relative pressure between the various pockets, with the overall effect being more pronounced when the pressure differences are the largest.

For the "undercompressing" condition, the leakage associated with a positive $dR_{is}$ will reduce the moment load on the scroll and the leakage associated with a negative $dR_{is}$ will increase the moment load. For these conditions, the moment associated with the leakage acts in the opposite direction from the moment associated with the mechanical forces. For conditions where the scrolls are overcompressing, the gas force will yield the opposite result.

FIG. 6 shows how initial swing radius bias changes the pressure moment in a machine having a positive initial swing radius bias (a fixed scroll with zero initial swing radius error and an orbiting scroll with a negative initial swing radius error), and FIG. 7 in a machine having a negative initial swing radius bias (a fixed scroll with zero initial swing radius error and an orbiting scroll with a positive initial swing radius error). CV is the central volume which is at discharge pressure and $V_{2A}$ and $V_{2B}$ are the next outward intermediate compression volumes or chambers. Because of the clearance D' in the positive initial swing radius bias example, leakage will occur between CV and $V_{2A}$, resulting in the pressure of $V_{2A}$ being different from the pressure of $V_{2B}$. Pressure from $V_{2A}$ acts on the outer wrap flank of the orbiting scroll from D' around to E'. Pressure from $V_{2B}$ acts on the inner wrap flank of the orbiting scroll from C around to B.

The gas forces resulting from these pressures act on the orbiting scroll both parallel to lines 18 and 20, as well as perpendicular thereto. The parallel components all balance out because for every place where there is a parallel gas force component on the orbiting scroll, there exists another place on the orbiting scroll where the force is equal, opposite, and collinear. This is true for positive, negative, and zero $R_{is}$ and $R_g$ biased machines. Looking at the perpendicular gas component, the force is balanced out in the direction normal to these parallel lines, except where indicated by segments 30 and 32 on lines 18 and 20 in FIG. 6. Segment 30, from B to C, represents the projected width of the inner wrap flank that has a gas force from $V_{2B}$ acting to the right without an equal, opposite, and collinear force somewhere else to offset it. Segment 32, from D' to E', represents the projected width of the outer wrap flank that has a gas force from $V_{2A}$ acting to the right without an equal, opposite, and collinear force somewhere else to offset it. The length of these segments is the pitch of the involute wrap. These unbalanced segments of pressure produce forces $F_i$ and $F_o$. The magnitude of these forces is equal to their respective pressure, times the wrap pitch, times the vane height. Each force is placed at the midpoint of its segment, as shown in FIG. 6 which is the centroid of the distribution of the pressure component. These two forces are equidistant from the midpoint between the generating circles 14 and 16 of the fixed and orbiting scrolls.

$F_o$ is the force due to pocket $V_{2A}$ on the orbiting scroll's outer wrap flank and $F_i$ is the force due to pocket $V_{2B}$ on the orbiting scroll's inner wrap flank. When the pockets $V_{2A}$ and $V_{2B}$ are equal in pressure, they are equal in net force on the orbiting scroll. This is the case in a nominal design. Force $F_i$, however, has a moment arm that is one orbit radius longer than that of $F_o$. Therefore, the sum of the moments about the center of the orbiting scroll (the center of the orbiting scroll's generating circle) yields a moment acting in the clockwise direction in that particular winding direction of the wraps. That is the usual moment on the orbiting scroll and anti-rotation device in a nominal design due to the pressures in these pockets.

The pressure effect due to a positive initial swing radius bias and an undercompression condition can be visualized in FIG. 6 where CV is at the highest pressure in the compressor and leaks gas back through D' into pocket $V_{2A}$, increasing its pressure above that of pocket $V_{2B}$. The net force $F_o$ will therefore become larger than $F_i$ as a consequence of which a sum of moments will show that the usual clockwise moment has been reduced, cancelled, or reversed if the pressure difference is large enough.

The pressure effect due to a negative initial swing radius bias and an undercompression condition can be visualized in FIG. 7, where CV is at the highest pressure in the compressor and leaks gas back through C' into pocket $V_{2B}$, increasing its pressure above that of pocket $V_{2A}$. The net force $F_i$ will therefore become larger than $F_o$ so that the sum of moments will show that the usual clockwise moment has been increased.

For the overcompression condition, the pocket with the larger clearance decreases in pressure as it leaks more gas into CV, opposite to the previous condition. Leakage introduced by a positive initial swing radius bias will therefore tend to increase the favorable moment loading on the orbiting scroll and anti-rotation device, while leakage introduced by a negative initial swing radius bias will therefore tend to decrease the favorable moment loading.

Generating Radius Bias

Generating radius bias is caused by introducing a positive or negative error into the radius of the generating circle for either or both wraps. Qualitatively, $dR_g$ will have the same overall effect on the moment loading as the $dR_{is}$. Quantitatively, the changes in the mechanical forces and the gas forces will be different because, unlike $dR_{is}$, the effect of the $dR_g$ is a function of the wrap angle. The two biases are, however, independent so they can be used together to optimize the moment loading on the orbiting scroll. As used herein, $dR_g$ is positive if the fixed scroll has a larger $R_g$ than the orbiting scroll.

Figure 8:
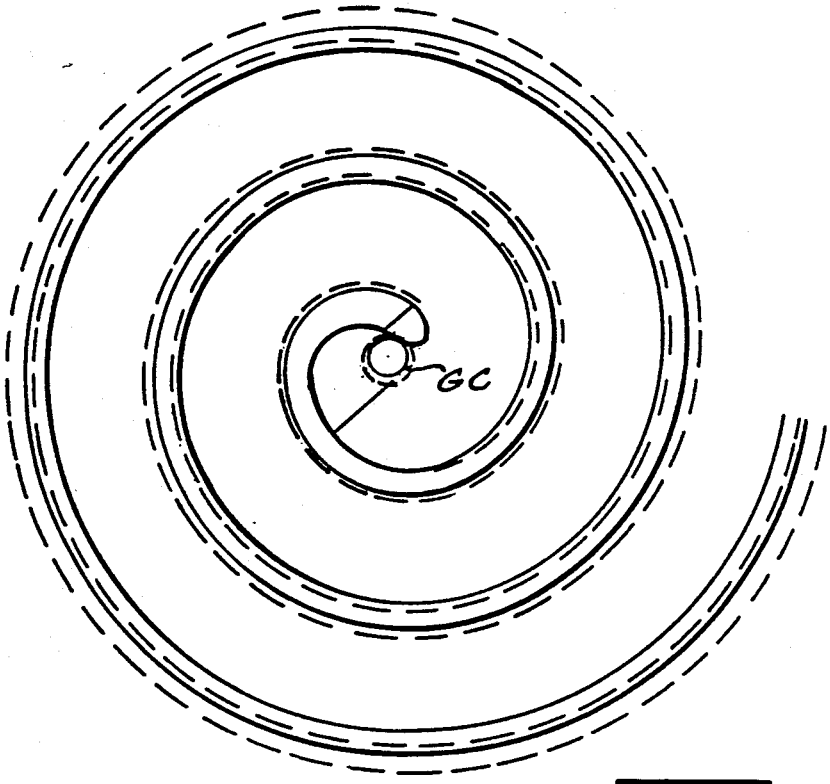
FIGS. 8 and 9 illustrate diagrammatically in an exaggerated manner, the effect, in dashed lines, of positive generating radius error and negative generating radius error, respectively.
Figure 9:
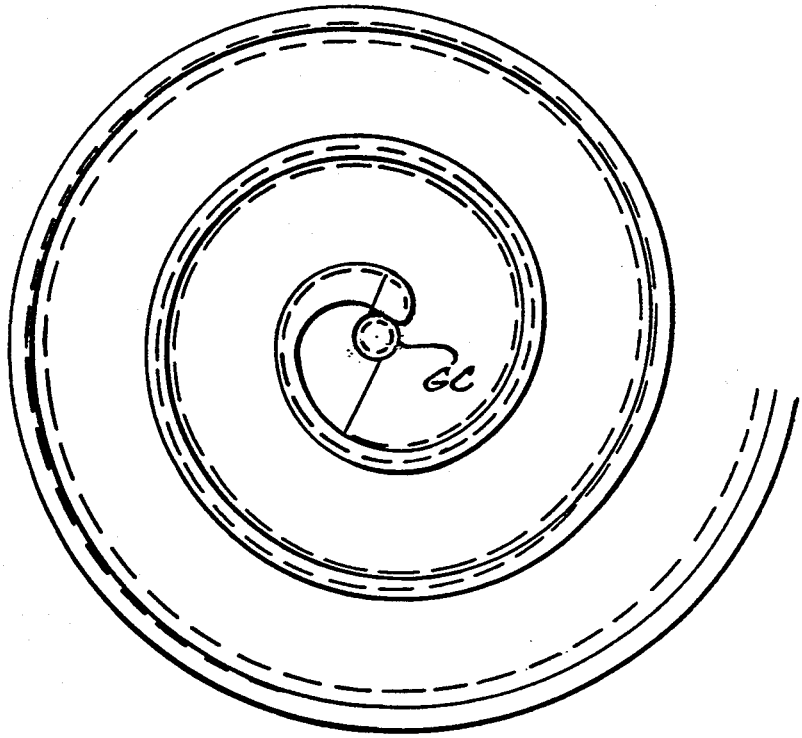

The effect on the profile of a positive generating radius error on a given wrap is illustrated in FIG. 8 wherein the dashed lines show the "deviant" profile. FIG. 9 shows the equivalent negative generating radius error profile. As can be seen, with an $R_g$ error the local error increases as the wrap angle increases, whereas with an $R_{is}$ error, the local error remains constant with wrap angle.

A positive generating radius bias, $dR_g$, as used herein, means that the fixed scroll has a greater generating radius $R_g$ than the orbiting scroll, and this is achieved by introducing an $R_g$ error to either or both of the wraps. As used herein, error means the difference from the nominal value. Thus, the fixed scroll could have a zero or negative $R_g$ error and the orbiting scroll a more negative $R_g$ error, or the fixed scroll could have a positive $R_g$ error and the orbiting scroll a zero or less positive $R_g$ error. Similarly, a negative generating radius bias $dR_g$ can be conversely obtained.

Figure 10:
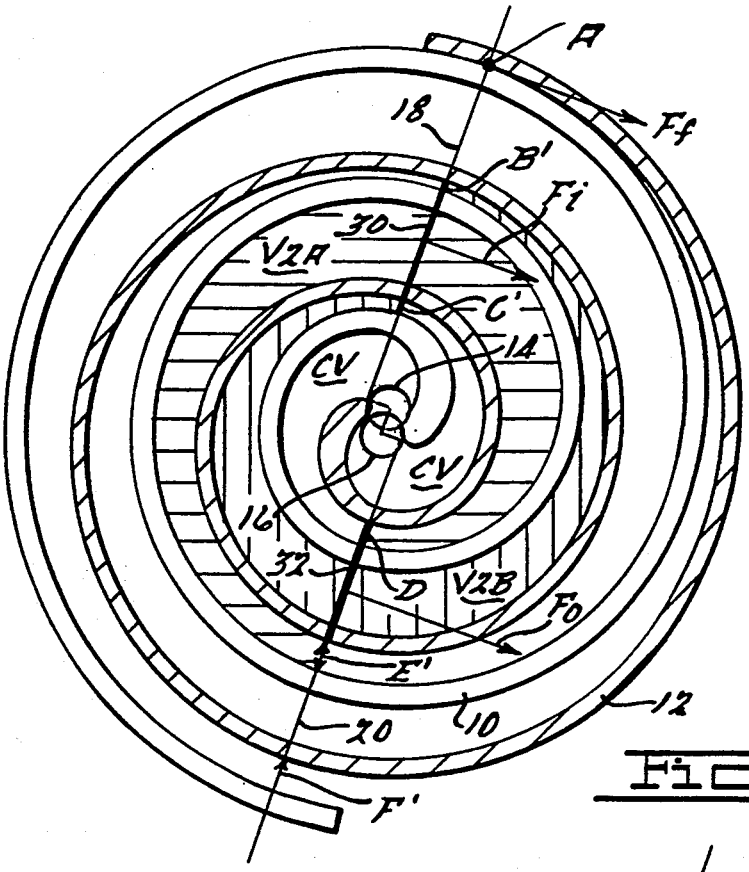
FIG. 10 illustrates diagrammatically in an exaggerated manner, the effect on a scroll set of a positive generating radius bias created by providing a negative generating error to the orbiting scroll.
Figure 11:
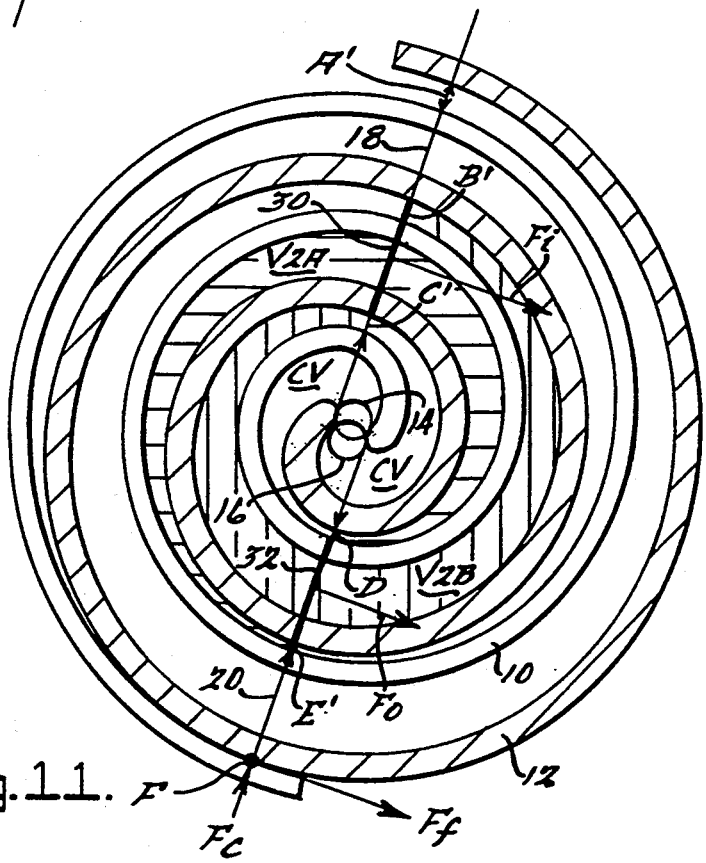
FIG. 11 illustrates diagrammatically in an exaggerated manner, the effect on a scroll set of a negative generating error bias created by providing a postive generating radius error on the orbiting scroll.

The effect of a positive $dR_g$ and a negative $dR_g$ on a scroll set having zero $dR_{is}$ is shown in FIGS. 10 and 11, respectively, for the "undercompression" case. For the positive $dR_g$ case, the bias is obtained by providing a negative $R_g$ error on the orbiting scroll and for the negative $dR_g$ case the bias is obtained by providing a positive $R_g$ error on the orbiting scroll. The fixed scroll has zero $R_g$ error. For the following discussion it is also assumed that the elastic deflections of the scroll flanks can be neglected. As can be seen in FIG. 10, for a positive $dR_g$, the only true contact point is at A, with progressively increasing clearances existing at points B through F, respectively. Conversely, for a negative $dR_g$, the only true contact point is at F, with progressively increasing clearance existing at points E through A, respectively.

The introduction of a $dR_g$ changes the mechanical forces in a manner similar to that for $dR_{is}$. From FIG. 10 it can be seen that the resultant contact force and friction force at point A will create a clockwise moment about the center of the orbiting scroll. conversely, in FIG. 11, the resultant contact force and friction force at point F create a counter clockwise moment. The gas moment associated with the compression process is still in the clockwise direction so the mechanical forces will increase the moment loading when a positive bias is introduced and they will reduce the moment loading when a negative bias is introduced.

The overall effect of a $dR_g$ on the gas forces is also similar to that for a $dR_{is}$. The $dR_g$ case is a little different, however, because leakage paths are introduced in all of the pockets and not just some of them. The magnitude of the leak paths (clearances) will be different so leakage will still result in a loss of pressure symmetry in the compressor. For the case shown in FIG. 10, the clearance C′ is smaller than the clearance D′. For the "undercompression" condition, there will be more leakage from CV into $V_{2A}$ than into $V_{2B}$ and the pressure in $V_{2A}$ will be higher than the pressure in $V_{2B}$. As a result, the net force $F_o$ will therefore become larger than $F_i$ as it did for the positive initial swing radius bias case, and the leakage will tend to reduce the favorable moment loading on the orbiting scroll and anti-rotation device. For the case shown in FIG. 11, the clearance D′ is smaller than the clearance C′ so there will be more leakage from CV into $V_{2B}$ than into $V_{2A}$ and the pressure in $V_{2B}$ will be higher than the pressure in $V_{2A}$. The net force $F_i$ will therefore become larger than $F_o$ as it did for the negative initial swing radius bias case, and the leakage will tend to increase the favorable moment loading on the orbiting scroll.

Interaction of dRs and dRg

Figure 12:
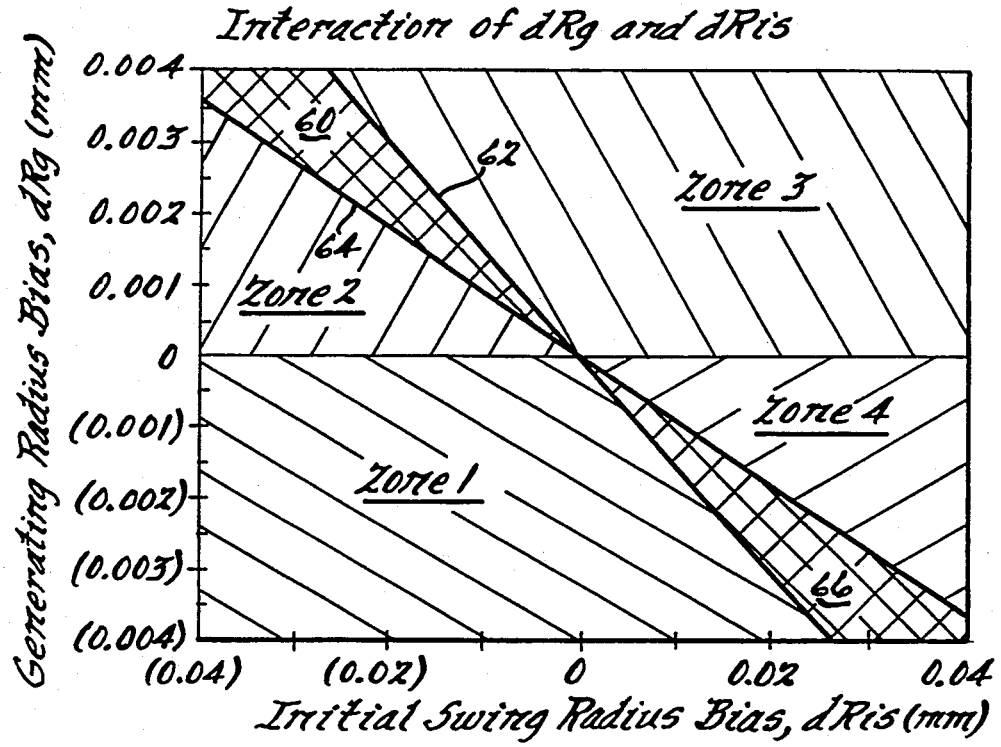
FIG. 12 is a graph illustrating the interrelationship of generating radius bias and initial swing radius bias.
Figure 13:
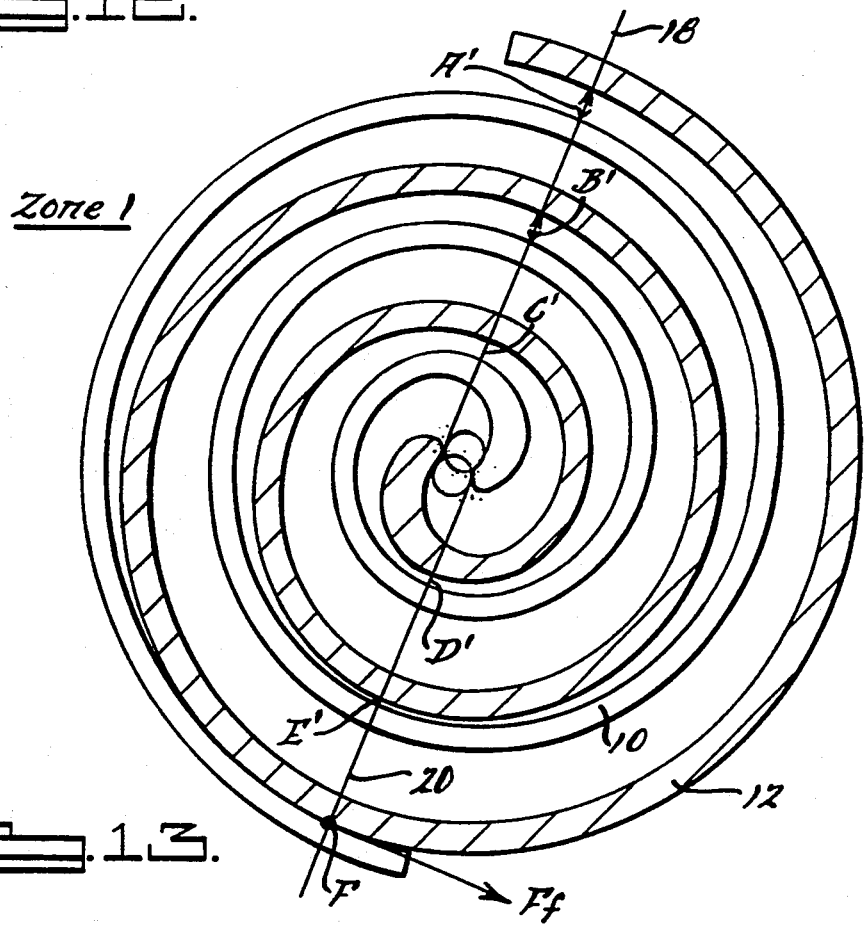
FIGS. 13–16 illustrate diagrammatically in an exaggerated manner, the effect on a scroll set of being located in Zones 1 through 4 in FIG. 12, respectively.
Figure 14:
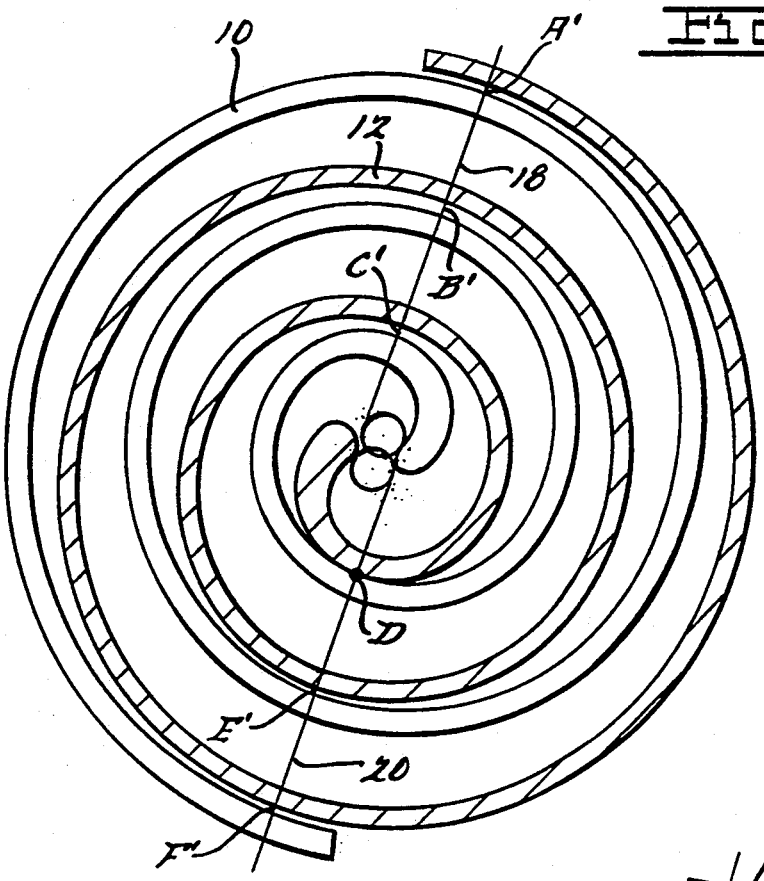
Figure 15:
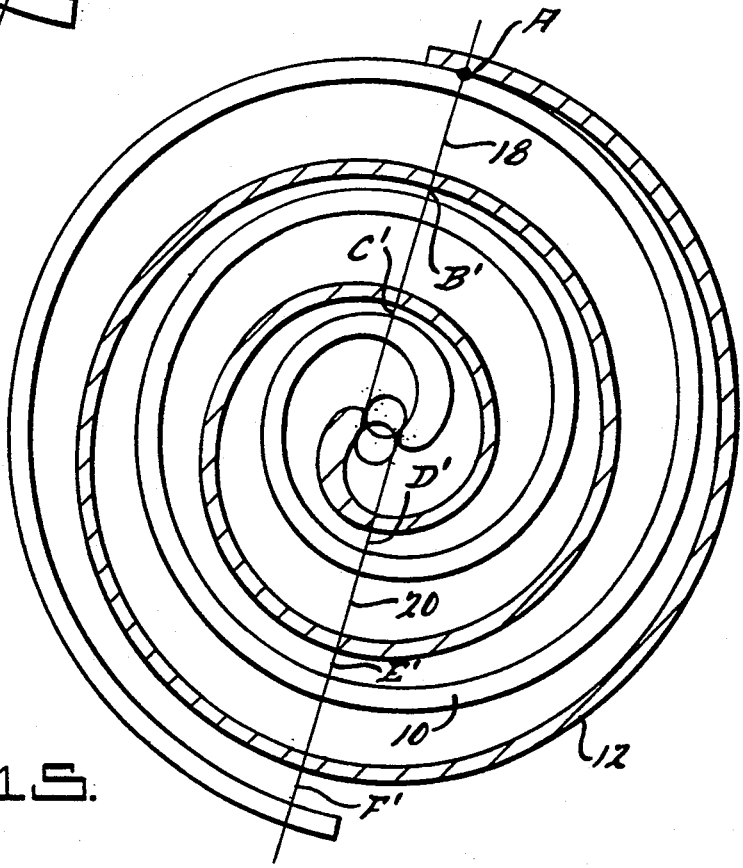

FIG. 12 illustrates graphically the relationship applicants' have discovered to exist between $dR_g$ and $dR_{is}$ for positive and negative values of each. The numerical values are millimeters (mm) and represent for each axis the amount of bias defined by the error on the fixed scroll minus the error on the orbiting scroll. The graph is specific to a machine of the general type shown in the aforecited United States Letters Patent, having an 831 degree working wrap for each scroll member. Zone 1 is where the fixed scroll inner wrap flank engages the orbiting scroll outer wrap flank in the suction area of the compressor at point F (see FIG. 13), Zone 2 is where the fixed scroll inner wrap flank engages the orbiting scroll outer wrap flank in the discharge port area at point D (see FIG. 14). Zone 3 is where the fixed scroll outer wrap flank engages the orbiting scroll inner wrap flank in the suction area at point A (see FIG. 15), and Zone 4 is where the fixed scroll outer wrap flank engages the orbiting scroll inner wrap flank in the discharge port area at point C (see FIG. 16). The two cross-hatched areas 60 and 66, defined by lines 62 and 64, represent transition zones where contact points are changing. Scroll sets produced in the cross-hatched areas will exhibit contact alternating between each of the adjoining zones at various positions of crank rotation.

Scroll Member Impact And Separation Impulses

Another source of noise is the contact event and separation event of the scroll wrap flanks. The short duration of the event yields an impulse force that not only makes its own noise, but also is able to drive a wide range of other frequencies, especially the natural frequencies of neighboring component systems. These impulse events are a consequence of scroll sets that do not share the same generating radius. Contacting flanks with a generating radius bias cause a variation in the orbit radius throughout the crank rotation. The orbit radius either gradually increases or gradually decreases from some crank position in the rotation back around to just before that position again.

One type of event occurs when the orbit radius is increasing with crank rotation. To get back to the starting position and orbit radius, mechanical interference forces a sudden inward motion of the orbiting scroll to occur. The impulsive force associated with this impact produces a once-per-revolution noise, and vibrates the components near it. When the particular point of interest and contact is the one established by the vanes at suction closing, an excessively noisy suction-closing impact occurs.

The other type of event occurs when the orbit radius is decreasing with crank rotation. The orbiting scroll moves radially inwardly until it returns to the crank angle of the starting position. There, it is suddenly released to "fall" outwardly (under the influence of the centrifugal force) until it reaches the starting orbit radius. It is "caught" by the next contact point and then the process repeats. The vane that was suddenly released experiences an impulse similar to a plucked string, and produces a once-per-revolution noise as well as vibrating the component systems around it in proportion to its ability to excite their natural frequencies. When the particular point of interest and separation is the one experienced by the vanes at discharge opening, an excessively noisy discharge-opening release occurs.

INVENTION—EXAMPLE 1

In production it has been found that it is easier to adjust or change $R_{is}$ than $R_g$. Therefore, if a design is located in Zone 4 it is possible to obtain the advantages of a positive friction loading moment within achievable manufacturing contraints. This is a zone where the gas moment due to $R_s$ bias is negative, however, the effect of this gas leakage can be reduced by also providing a negative $R_g$ bias. This tends to close the clearances along line 20 to reduce leakage and it also gives a positive gas moment. Furthermore, the leakage occurs in the discharge area so there is a minimal effect on capacity. This embodinent of the discovery provides significant sound attenuation because it minimizes change in orbit radius during closing of the suction pockets on the outer wraps.

It is believed that a suction-closing impact produces more noise than a discharge-opening release of equal displacement. Contacting on flank sections that do not have a generating radius bias offers the best solution because it avoids both types of events. There is no sudden change in the orbit radius at any position of the crank rotation. When the variation of manufactured parts produces a generating radius bias that results in a sudden change in the orbit radius at one crank position, the best choice is to avoid the suction-closing impact and accept the discharge-opening release. Zone 2 and Zone 4 are therefore preferred over Zone 1 and Zone 3 to minimize this noise.

Figure 17:
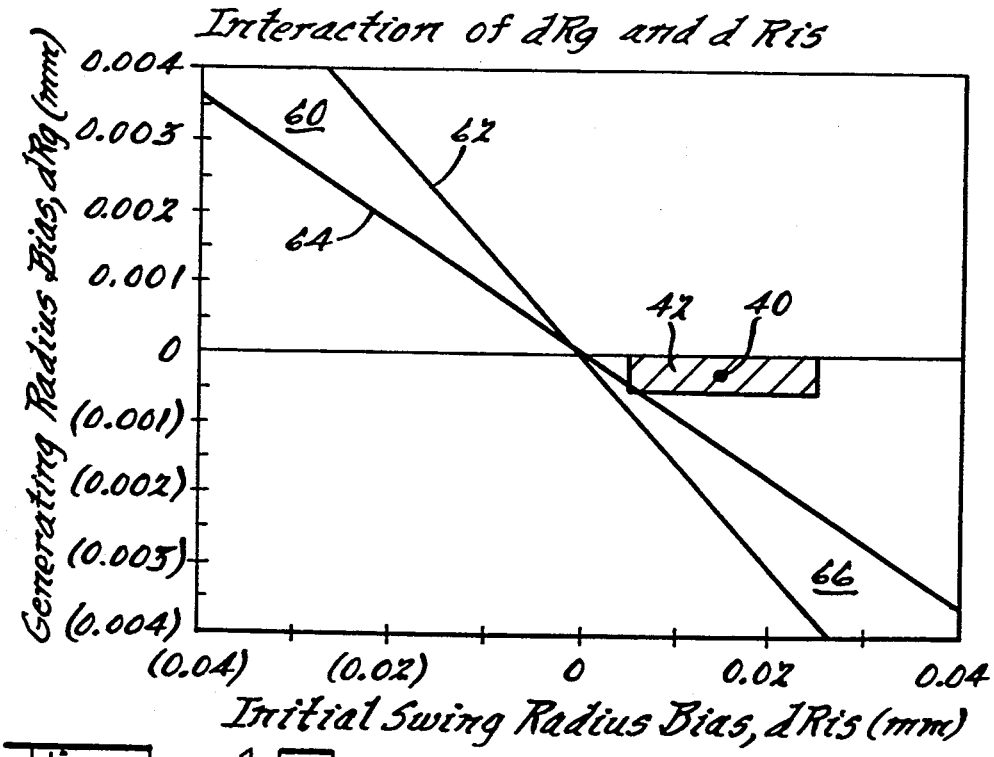
FIG. 17 is similar to FIG. 12 but illustrates a target area for a preferred embodiment of the present invention.

It has been discovered that for an average size residential air-conditioning or heat pump compressor an ideal target value is a positive $R_{is}$ bias of 0.015 mm, with a tolerance range of +/−0.010 mm, in combination with a negative generating radius bias of 0.0002 mm with a tolerance of +/−0.0002 mm. The target point is shown at 40 in FIG. 17 and the tolerance range is shown at 42. It is believed to be very important to maintain range 42 of this example below the zero $R_g$ bias line. A more general (less machine size dependent) way to express $dR_{is}$ for this approximate target area is in terms of $R_g$. Thus, $dR_{is}$ can be chosen to be 0.000 to 0.012 times $R_g$, or preferably approximately 0.006 times $R_g$.

INVENTION—EXAMPLE 2

Figure 18:
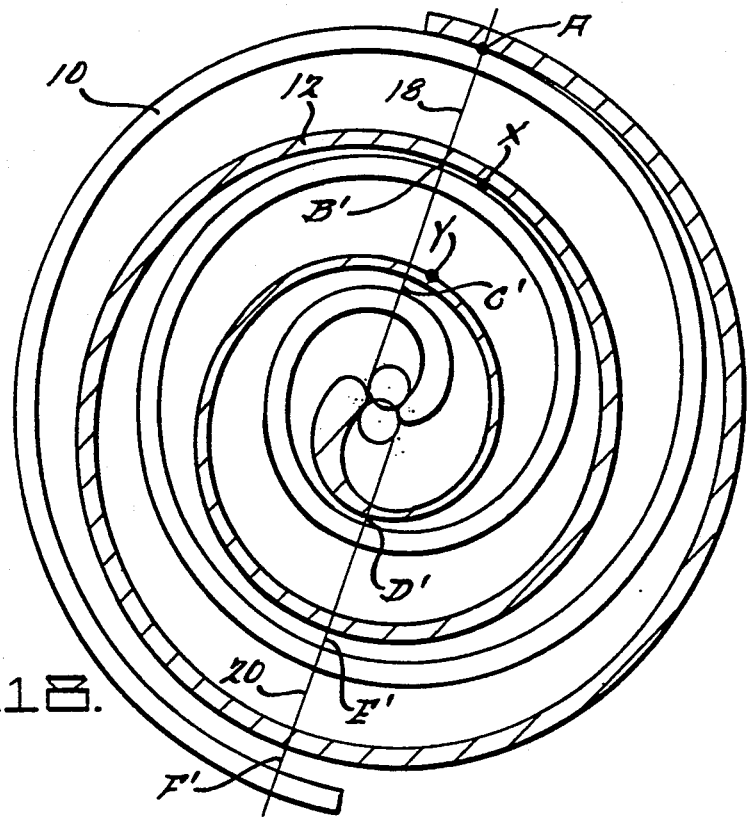
FIGS. 18–20 illustrate in a greatly exaggerated manner scroll sets incorporating further embodiments of the present invention.

FIG. 18 illustrates another discovery that applicants have made about the generating radius. FIG. 18 is similar to FIG. 15 in that the fixed scroll outer wrap flank engages the orbiting scroll inner wrap flank in the suction area at point A. FIG. 18 is different from FIG. 15 in that whereas the clearance increases proportionally proceeding along the line 18 and line 20 from point A to the opposite side of the scroll in FIG. 15, the clearance does not increase proportionally proceeding along the line 18 and line 20 from point A to the opposite side of the scroll in FIG. 18. For example, note that clearance C′ is larger than clearance D′. This is accomplished by employing multiple generating radii on at least one of the scroll wraps to change the pitch of each surface locally. Each flank is begun with a particular generating radius, and at some position or positions along the flank, a change occurs in the size of the generating radius used to generate that flank.

Having Clearance C′ larger than Clearance D′ modifies the previously explained relationship between generating radius bias and leakage, pressure and gas moment asymmetry of pockets $V_{2A}$ and $V_{2B}$. By properly selecting the range of initial swing radius bias to compliment this unique feature, Clearance C′ can be equal to Clearance D′ thereby producing a neutral effect, or sufficiently larger than Clearance D′ thereby producing a gas moment that adds to the usual moments on the anti-rotation device. With this design it is possible to have a positive gas moment and also have positive contact and friction moments.

The enlargement of Clearance C′ could be construed as an additional negative impact on performance. However, it is compensated by the reduction in Clearance D′, E′ and F′. Actually, the range of superior performance using some combinations of biased multiple generating radii and biased initial swing radius has been evaluated to be larger than the combinations obtained by biasing single generating radii and initial swing radii.

In the particular example of FIG. 18, the fixed scroll wrap is standard and described by a single generating radius. The orbiting scroll wrap is designed in such a way that, combined with the fixed scroll wrap, the set has a negative initial swing radius bias, a positive generating radius bias between the fixed scroll wrap and the outward portion of the orbiting scroll wrap, and a smaller positive generating radius for the inward portion of the orbiting scroll wrap than the outward portion of the wrap. The change from one generating radius to the other, on the orbiting scroll, occurs slightly more than one full wrap after suction closing, such as at points x and y in FIG. 18.

Figure 16:
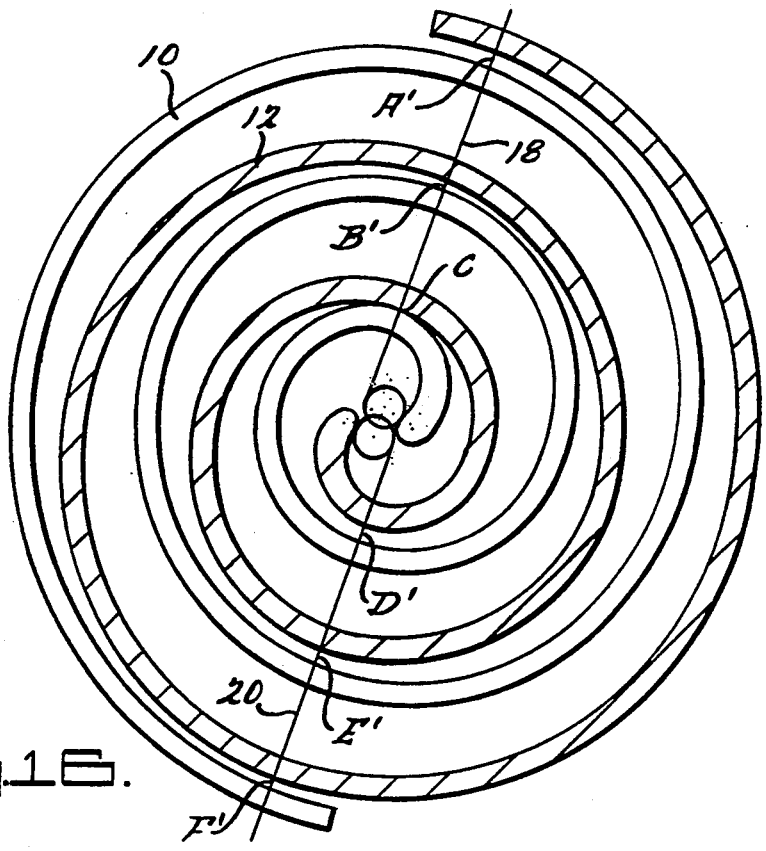
Figure 19:
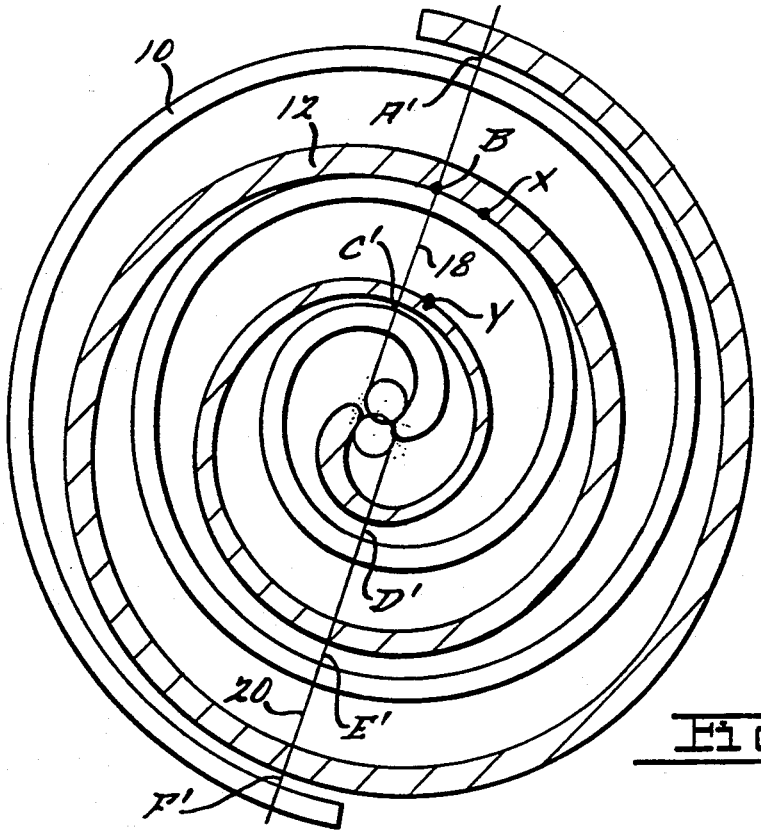

FIG. 19 illustrates another advantage applicants have discovered to exist with flanks employing generating radii, namely the absence of suction closing impact and discharge release impulse. FIG. 19 is similar to the embodiment of Example 1, as shown in FIG. 16, in that the Clearance D′ is greater than the Clearance E′, which is greater than the Clearance F′. These two figures are also similar in that the fixed scroll outer wrap flank engages the orbiting scroll inner wrap flank, and further that both have a clearance A′. FIG. 19 is different from FIG. 16 in that whereas the contact is at discharge point C in FIG. 16, the contact is at the middle of the wrap, point B, in FIG. 19. This is accomplished by employing multiple generating radii on at least one of the scroll wraps to change the pitch of each surface locally. Each flank is begun with a particular generating radius, and at some position or positions along the flank, a change occurs in the size of the generating radius used to generate that flank.

FIG. 19 illustrates that by employing multiple generating radii, the flank contact can be limited to the middle portion of the wraps. Unlike flanks made with a single generating radius, there are zones of initial swing radius bias and generating radius bias combinations that always have clearance at the ends of the wraps. This can be understood by considering a contact point as it moves from suction closing to discharge opening. Suction closing is a virtual seal-off without actual contact. The actual contact occurs only after the seal point moves inward from the end. On the discharge end of the wrap, before the contact abruptly unloads by running out of opposing flank at discharge, it transfers the load to a contact that, moving inward from suction, assumes the flank load. As the discharge contact continues to approach the inward end of the wrap, it develops a slight clearance and becomes a virtual seal-off again. Contact can therefore be, by design, restricted to the portions of wrap with more uniform strength and stiffness, and away from the portions of the wrap with high radii of curvature and therefore highest contact stress. This design eliminates the need for flank feathering (such as disclosed in assignee's U.S. Letters Pat. No. 4,927,341) because it provides the same result.

In the particular example of FIG. 19, the fixed scroll wrap is standard and described by a single generating radius. The orbiting scroll wrap is designed in such a way that, combined with the fixed scroll, the set has a positive initial swing radius bias, a negative generating radius bias between the fixed scroll wrap and the outward portion of the orbiting scroll wrap, and a smaller generating radius for the inward portion of the orbiting scroll wrap than the outward portion of the wrap. This smaller generating radius yields a positive generating radius bias between the inward portion of the orbiting scroll wrap and the fixed scroll. The change from one generating radius to the other, on the orbiting scroll, occurs slightly more than one full wrap after suction closing, such as at points x and y in FIG. 19.

There are geometric requirements additional to those for FIG. 16 necessary to achieve the contact illustrated in FIG. 19. These pertain to how the multiple generating radius bias is employed on the flanks that are in contact (for example, illustrated in FIG. 19 as the fixed scroll outer flank and the orbiting scroll inner flank). Generally, the idea is to make a smooth transfer of the flank load from one contact point to the next without the occurrence of an impulsive force. To do this, the form relationship between the place where the two flanks contact and the place where the clearance is closing for the next contact must make a smooth reduction of that clearance possible. Recalling that generating radius bias changes the orbit radius from one crank position to another, the orbiting scroll must therefore be radially inboard of the next contact that will assume the flank load, and the orbiting scroll must be gently let out against the fixed scroll while traveling at full speed. Then the orbiting scroll must be gently lifted back off that contact before it falls off the end of the vane. Every portion of the wrap that makes contact must break contact with these constraints. Each portion of wrap must therefore accomplish a reduction and increase of the orbit radius over that portion of continuous contact. Specifically, the generating radius bias must change signs between the outward (nearer suction) and inward (nearer discharge) portion of any portion of wrap having continuous contact. For contact between the fixed scroll outer wrap flank and the orbiting scroll inner wrap flank, the generating radius bias must be negative on the outward portion of the wraps, and change to be positive on the inward portion of the wraps. The opposite is true for contact between the fixed scroll inner wrap flank and the orbiting scroll outer wrap flank. The profile of the mating surfaces must have sufficient material in the central portions of the wraps to force clearance of the end portions of the wraps at all crank positions. Every wrap portion having continuous contact must decrease the orbit radius (the radial separation of the generating circles of the two scroll members) until it is inboard of what the next contact will require, and then increase the orbit radius until the transfer of contact occurs.

Figure 20:
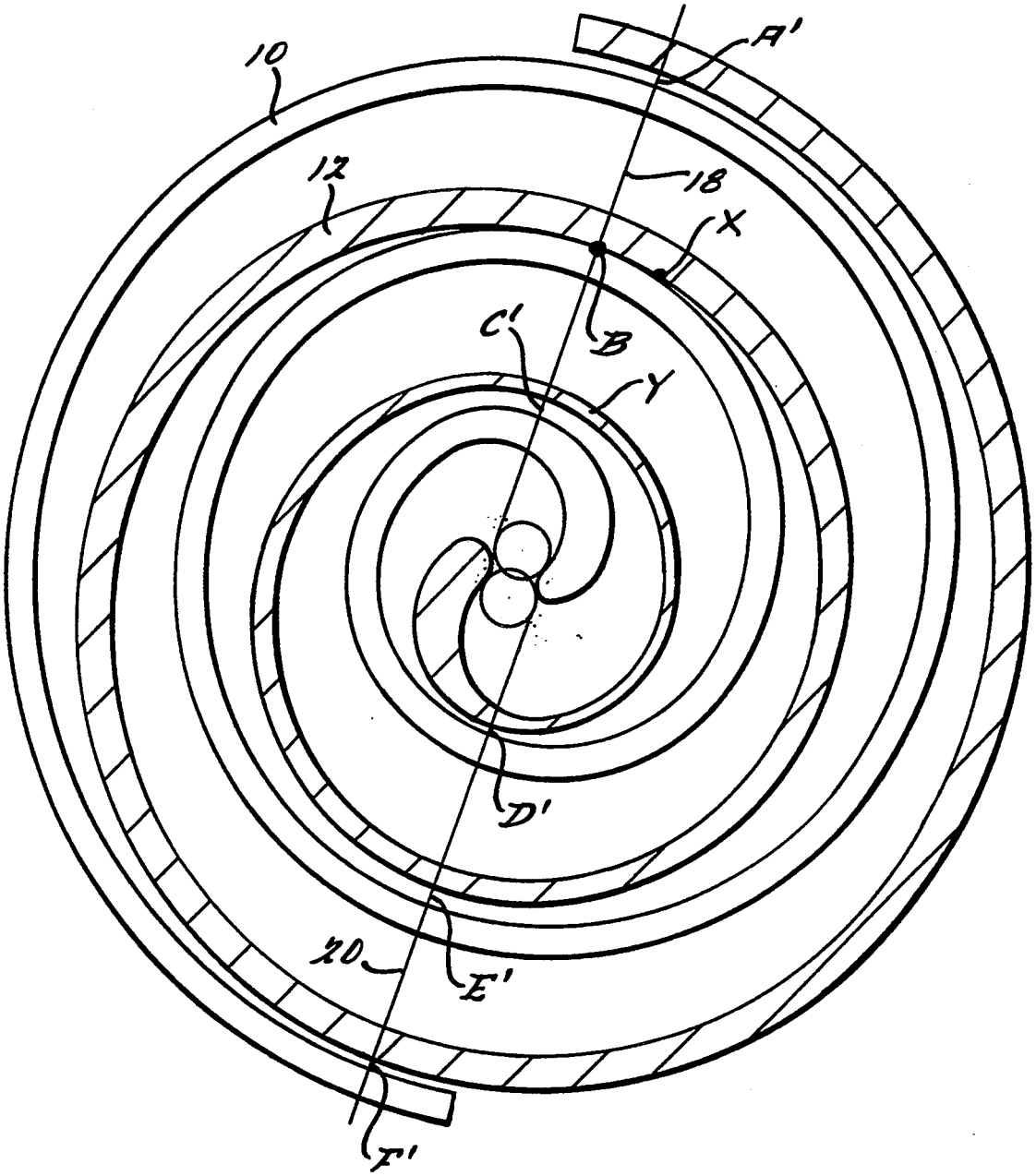

FIG. 20 illustrates the product of combining the discoveries illustrated in FIG. 18 and FIG. 19. The embodiment of FIG. 20 therefore represents what has been discovered to be a theoretically superior design to achieve maximum sound attenuation because the machine will have (a) positive friction moments, (b) positive leakage moments, (c) no suction-closing impact, (d) no discharge contact release impulse, and (e) good efficiency.

In the particular example of FIG. 20, the fixed scroll wrap is standard and described by a single generating radius. The orbiting scroll wrap is designed in such a way that, combined with the fixed scroll, the set has a negative initial swing radius bias, a negative generating radius bias between the fixed scroll wrap and the outward portion of the orbiting scroll wrap, and a smaller generating radius for the inward portion of the orbiting scroll wrap than the outward portion of the wrap. This smaller generating radius yields a positive generating radius bias between the inward portion of the orbiting scroll wrap and the fixed scroll. The change from one generating radius to the other, on the orbiting scroll, occurs slightly more than one full wrap after suction closing, such as at points x and y in FIG. 20.

In the general case, multiple generating radii can be employed on the fixed scroll, the orbiting scroll, or both. The difference between the generating radii for the respective portions of the wraps is selected to achieve the desired arrangement of contacts and clearances as described above, however, the difference should be of relatively small magnitude, i.e., preferably not greater than 0.1% of the $R_g$. The transition in the generating radius must occur away from the ends of the wrap flank to be effective over the greatest variation in generating radius bias manufactured. To minimize the capacity loss due to suction pocket leakage it is preferable to have the transition nearer to suction. To minimize the power consumption of recompression work it is preferable to have the transition nearer to discharge. The evidence suggests that the generally best location for the transition is near the angular center of the working wraps.

THE PRIOR ART

Figure 21:
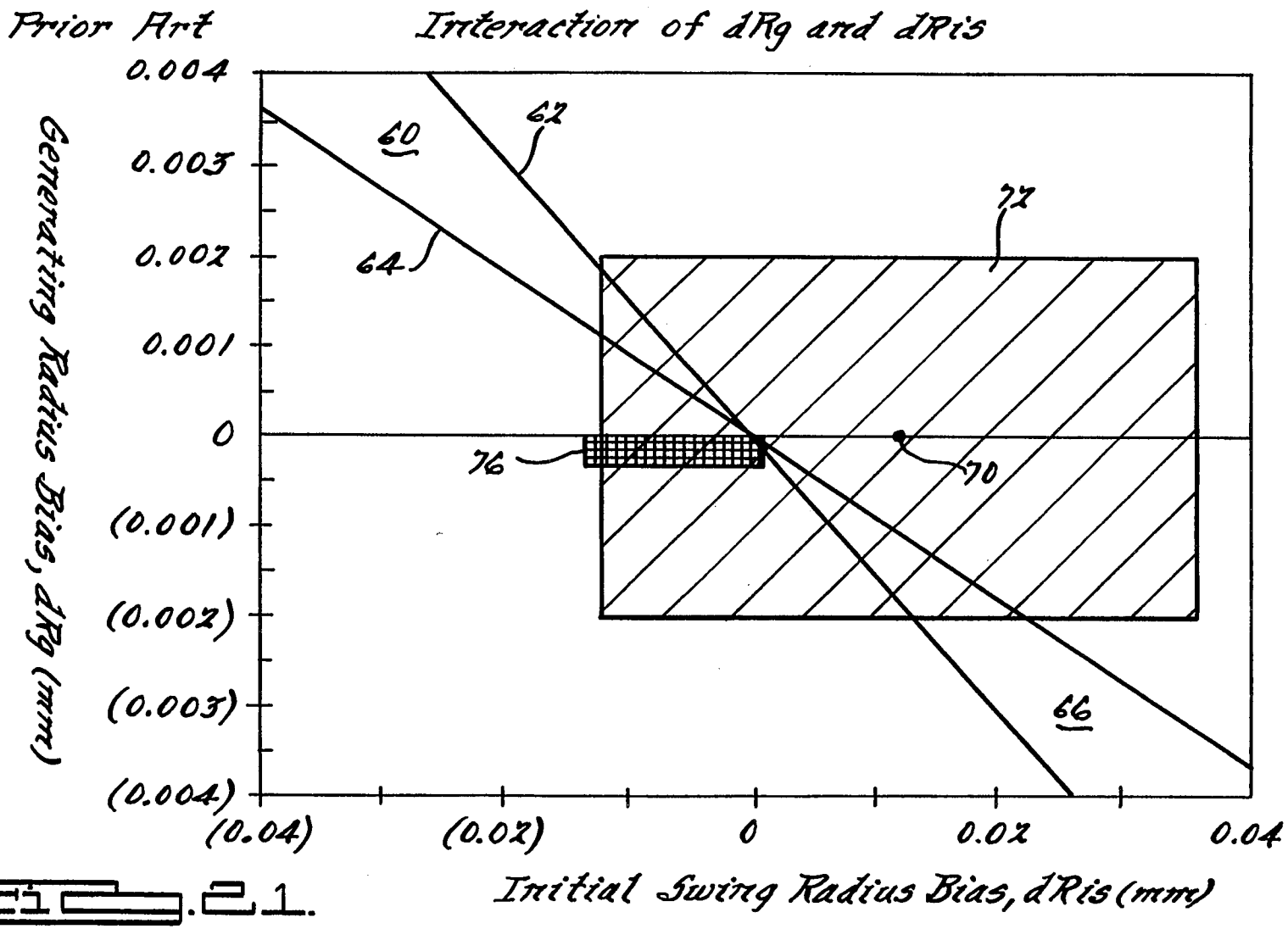
FIG. 21 is similar to FIG. 12 illustrating prior art relationships.

Insofar as the present invention is concerned, applicants' knowledge of the prior art is limited to the designs of the scroll compressors manufactured by their assignee. Prior to September, 1990, there was no appreciation of the possible significance of $R_{is}$ bias and $R_g$ bias and all production was targeted at zero, zero bias. From September, 1990, however, the scroll compressors manufactured by applicants' assignee were targeted to be manufactured with zero $R_g$ and 0.012 mm positive $dR_{is}$, i.e., point 70 in FIG. 21, which is similar to FIG. 12. The variances were +/−0.024 mm $dR_{is}$ and +/−0.002 mm $dR_g$, so the area indicated at 72 is where the compressors were targeted to be manufactured. It was believed at the time that this would provide better sound attenuation because it would provide more consistent and favorable flank contact. It turned out that many of these compressors had an improved sound level, but many did not. The results were not consistent. An experimental investigation was then conducted and it was concluded that a negative $dR_{is}$ and a slightly negative $dR_g$ would provide an acceptable sound level on a more consistent basis. Accordingly, starting October, 1991 the biases were targeted at −0.006 mm $dR_{is}$ (+/−0.007 mm) and −0.0002 mm $dR_g$ (+/−0.0002 mm). This target point is shown in FIG. 21 at 74 and the tolerance area at 76. The resulting compressors were found to have much more consistency in performance, which was a desired goal, but not quite as low a sound level. This indicated that applicants' still had little real appreciation of the best way to use biasing values to achieve the desired sound attenuation. Consequently, a very in depth, detailed analysis was made, the results of which are set forth hereinabove. This analysis was made at much finer levels and dynamic modeling software was developed to evaluate the effect of various parameters. What applicants' discovered was the criticality of certain parameters, the preferred values thereof, and how they must be precisely controlled. It was learned that targeting the biasing to the previous values did not satisfactorily achieve the desired result because the previous investigation was only experimental, including other parameters, and was made at too coarse a level. On the other hand, the later investigation revealed that precisely controlling $dR_{is}$ and $dR_g$ in the manner set forth in the two examples has been found to yield surprising and significant benefits. Applicants had been previously unaware that a dramatic improvement in sound level could be achieved simply by controlling dRs and dRg in the aforesaid manner.

Throughout the entire period of assignees' production to date, all of the $R_{is}$ and $R_g$ biasing described was accomplished by changing the position of the profile of the scroll wraps on the end plate. During this period, all the components of the entire Oldham coupling mechanism (all the keys and slots) were targeted for zero $R_{is}$ bias, and the alignment of the fixed scroll and orbiting scroll was also targeted for zero $R_{is}$ bias.

An Applicable Compressor Design

Figure 22:
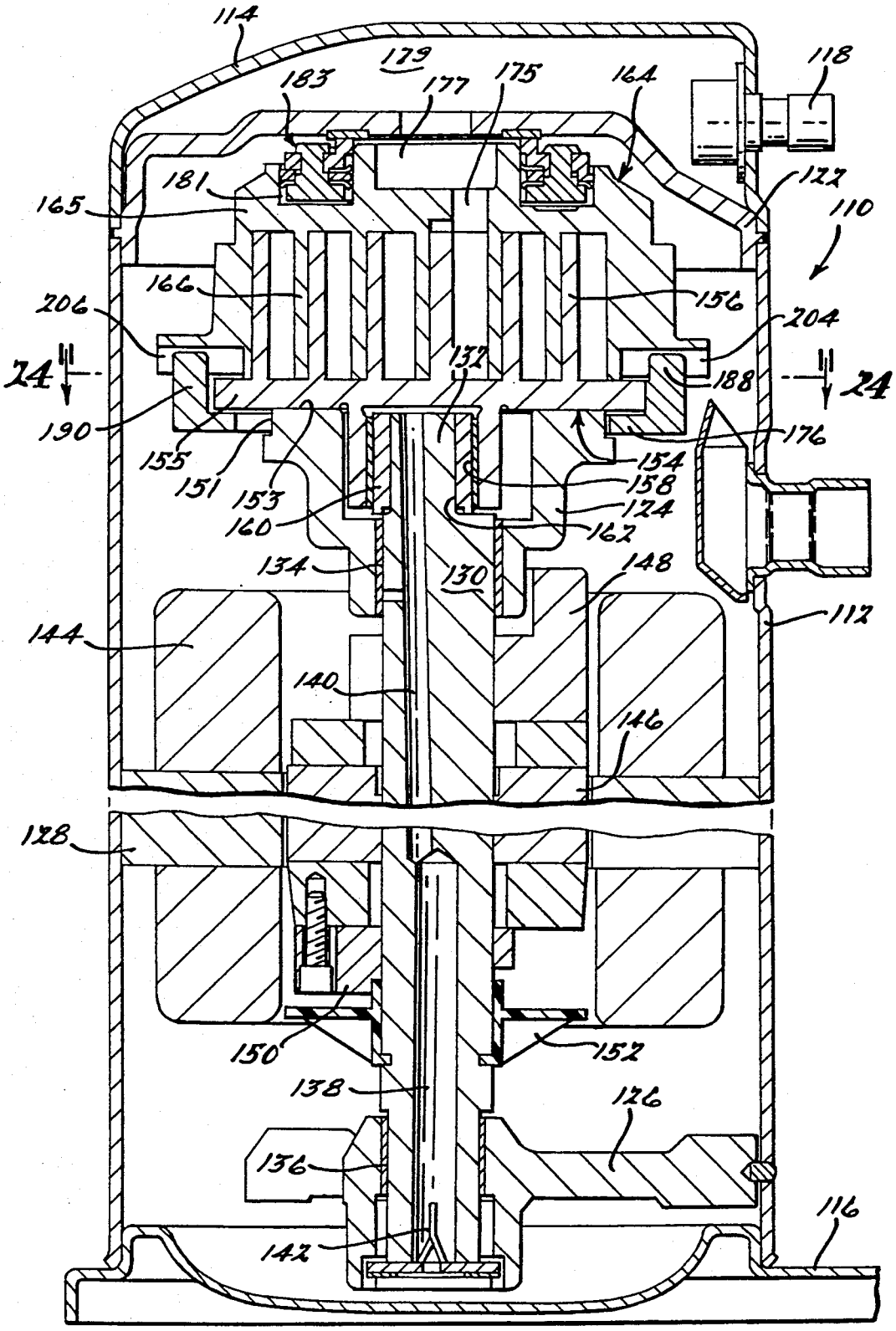
FIG. 22 is a vertical section view of a scroll-type refrigeration compressor suitable for practicing the present invention.

In FIGS. 22 through 26 there is disclosed a scroll compressor of the type to which this invention is applicable. Referring in particular to FIG. 22, a compressor 110 is shown which comprises a generally cylindrical hermetic shell 112 having welded at the upper end thereof a cap 114 and at the lower end thereof a base 116 having a plurality of mounting feet (not shown) integrally formed therewith. Cap 114 is provided with a refrigerant discharge fitting 118 which may have the usual discharge valve therein (not shown). Other major elements affixed to the shell include a transversely extending partition 122 which is welded about its periphery at the same point that cap 114 is welded to shell 112, a main bearing housing 124 which is suitably secured to shell 112 and a lower bearing housing 126 also having a plurality of radially outwardly extending legs each of which is also suitably secured to shell 112. A motor stator 128 which is generally square in cross-section but with the corners rounded off is pressfitted into shell 112. The flats between the rounded corners on the stator provide passageways between the stator and shell, which facilitate the flow of lubricant from the top of the shell to the bottom.

A drive shaft or crankshaft 130 having an eccentric crank pin 132 at the upper end thereof is rotatably journaled in a bearing 134 in main bearing housing 124 and a second bearing 136 in lower bearing housing 126. Crankshaft 130 has at the lower end a reltively large diameter concentric bore 138 which communicates with a radially outwardly inclined smaller diameter bore 140 extending upwardly therefrom to the top of the crankshaft. Disposed within bore 138 is a stirrer 142. The lower portion of the interior shell 112 is filled with lubricating oil, and bore 138 acts as a pump which forces lubricating fluid up the crankshaft 130 and into passageway 140 and ultimately to all of the various portions of the compressor which require lubrication.

Crankshaft 130 is rotatively driven by an electric motor including stator 128, windings 144 passing therethrough and a rotor 146 pressfitted on the crankshaft 130 and having upper and lower counterweights 148 and 150 respectively. A counterweight shield 152 may be provided to reduce the work loss caused by counterweight 150 spinning in the oil in the sump.

A generally cylindrical upper portion 151 of main bearing housing 124 defines a flat thrust bearing surface 153 on which is supported an orbiting scroll 154 comprising an end plate 155 and a spiral vane or wrap 156 projecting from the upper surface thereof. Projecting downwardly from the lower surface of the end plate of orbiting scroll 154 is a cylindrical hub having a journal bearing 158 therein and in which is rotatively disposed a drive bushing 160 having an inner bore 162 in which crank pin 132 is drivingly disposed. Crank pin 132 has a flat on one surface which drivingly engages a flat surface (not shown) formed in a portion of bore 162 to provide a radially compliant driving arrangement, such as disclosed in assignee's U.S. Letters Pat. No. 4,877,382, the disclosure of which is herein incorporated by reference.

A non-orbiting scroll memember 164 is also provided having an end plate 165 and a wrap 166 projecting therefrom which is positioned in meshing engagement with wrap 156 of scroll 154. Non-oribiting scroll 164 has a centrally disposed discharge passage 175 which communicates with an upwardly open recess 177 which in turn is in fluid communication with a discharge muffler chamber 179 defined by cap 114 and partition 122. An annular recess 181 is also formed in non-orbiting scroll 164 within which is disposed a seal assembly 183. Recesses 177 and 181 and seal assembly 183 cooperate to define axial pressure biasing chambers which receive pressurized fluid being compressed by wraps 156 and 166 so as to exert an axial biasing force on non-orbiting scroll member 164 to thereby urge the tips fo respective wraps 156, 166 into sealing engagement with the opposed end plate surfaces.

Figure 23:
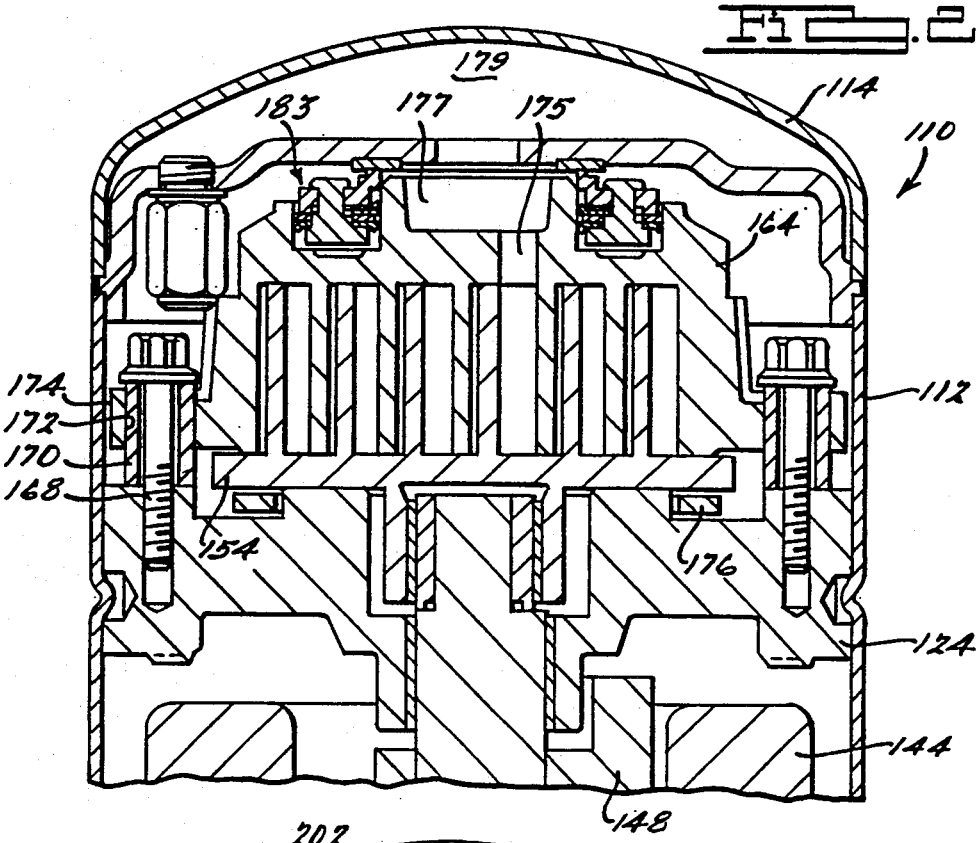
FIG. 23 is a fragmentary section view similar to that of FIG. 22 but with the section being taken along a plane passing through the non-orbiting scroll mounting arrangement, all in accordance with the present invention.

As best seen with reference to FIG. 23, non-orbiting scroll member 164 is designed to be mounted to bearing housing 124 by means of a plurality of circumferentially spaced bolts 168 extending through respective bushings 170 which are slidably fitted within bores 172 provided in radially outwardly projecting flange portions 174 integrally formed on non-orbiting scroll member 164. Preferably, the length of bushings 170 will be such as to provide a slight clearance between the lower surface on the head of bolts 168 and the upper surface of flange portion 174 so as to allow a slight axial movement of scroll member 164 in a direction away from scroll member 154. This mounting arrangement, as well as other alternative mounting arrangements, are disclosed in greater detail in applicants' assignee's above-referenced U.S. Pat. No. 5,102,316 entitled "Non-Orbiting Scroll Mounting Arrangements For A Scroll Machine". Other alternative mounting arrangements are disclosed in assignee's above referenced U.S. Letters Pat. No. 4,877,382.

In order to prevent relative rotation between scroll members 154 and 164, an Oldham coupling 176 is provided being positioned in surrounding relationship to cylindrical portion 151 (FIG. 22) of main bearing housing 124 and immediately below the end plate of scroll member 154.

As best seen with reference to FIGS. 25 and 26. Oldham coupling 176 includes an annular ring portion 178, the inner periphery of which is non-circular in shape being defined by two generally circular arc segments 180 and 182 each of a substantially constant radius R the opposed ends of which are interconnected by substantially straight segments 184 and 186 of a length L. Preferably, the radius R of arcs 180 and 182 will be approximately equal to the radius of cylindrical portion 151 provided on main bearing housing 124 plus a small clearance. The length L of straight segments 184 and 186 will preferably be approximately equal to twice the orbiting radius of the orbiting scroll member 154 plus a slight clearance.

A pair of keys 188 and 190 are provided on annular ring 178 in diametrically aligned relationship and projecting axially upwardly from surface 192 thereof. A second pair of keys 194 and 196 are also provided on annular ring 178 also projecting axially upwardly from surface 192 thereof. Keys 194 and 196 are aligned along a line which is substantially perpendicular to the diameter along which keys 188 and 190 are aligned but shifted radially toward key 190. Additionally, keys 194 and 196 are positioned on outwardly projecting flange portions. Both the radial shifting and outward positioning of keys 194 and 196 cooperate to enable the size of Oldham coupling 176 to be kept to a minimum for a given size compressor and associated shell diameter while enabling the size of thrust surface 153 to be maximized for this same compressor, as well as to avoid interference with the location and extent of wrap 156 of orbiting scroll member 154.

Figure 24:
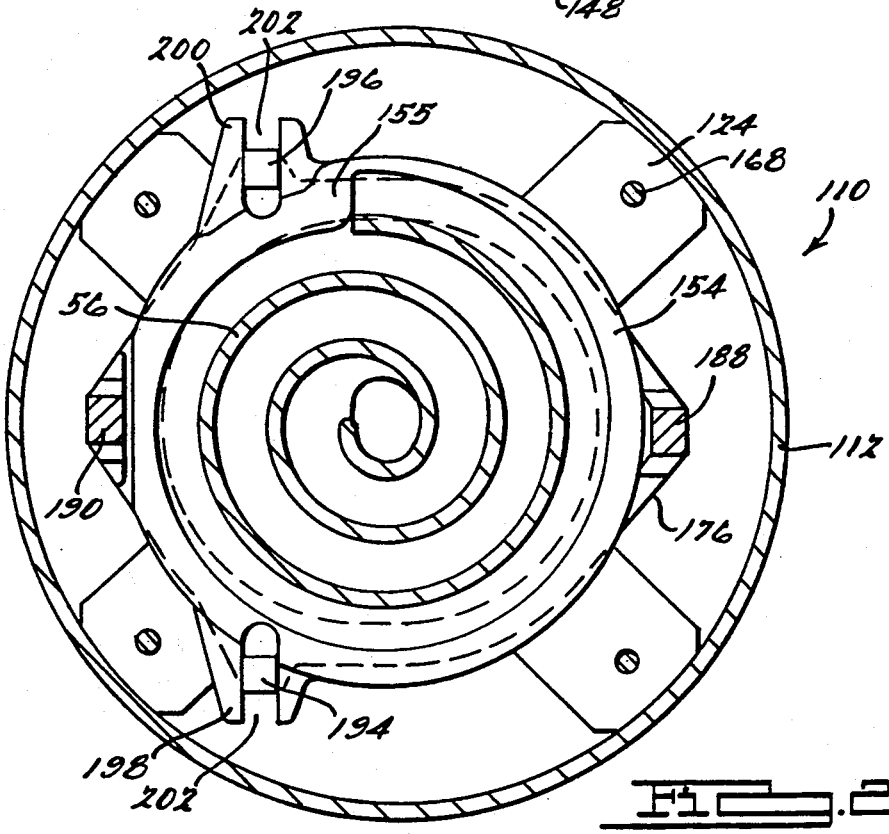
FIG. 24 is a section view taken along line 24—24 in FIG. 22.

As shown in FIG. 24, the end plate 155 of orbiting scroll member 154 is provided with a pair of outwardly projecting flange portions 198 and 200 each of which is provided with an outwardly opening slot 202. Slots 202 are aligned on the same line and are sized to slidingly receive respective keys 194 and 196. Keys 194 and 196 have an axial length or height which will avoid projecting above the upper surface of end plate 155 of orbiting scroll member 154.

Referring once again to FIG. 22, non-orbiting scroll 164 is similarly provided with a pair of radially extending slots 204 and 206 which are aligned on the same line and designed to receive respective keys 188 and 190. Keys 188 and 190 are substantially longer than keys 194 and 196 and of sufficient length to project above end plate 155 of scroll 154 and remain in engagement with slots 204 and 206 throughout the limited axial movement of non-orbiting scroll 164 noted above. It should be noted, however, that preferably a slight clearance will be provided between the end of respective keys 188 and 190 and the overlying surfaces of respective slots 204 and 206 when scroll member 164 is fully seated against scroll member 154, thereby avoiding any possibility of interference with the tip sealing between the respective scroll members.

As may now be appreciated, Oldham coupling 176 serves to directly interconnect and prevent any relative rotation between scroll members 154 and 164 through the cooperative action of the abutment surfaces provided by respective slots 202, 204 and 206 and associated keys 194 and 196 and 188 and 190. Similarly, the mounting arrangement of scroll 164 to bearing housing 124 will operate to effectively prevent relative rotation of scroll member 164 with respect to bearing housing 124 and hence also prevent relative rotation of scroll member 154 with respect to bearing housing 124. As described to this point, the Oldham coupling arrangement is for a compressor of nominal design.

APPLICATIONS OF THE INVENTION

Figure 27:
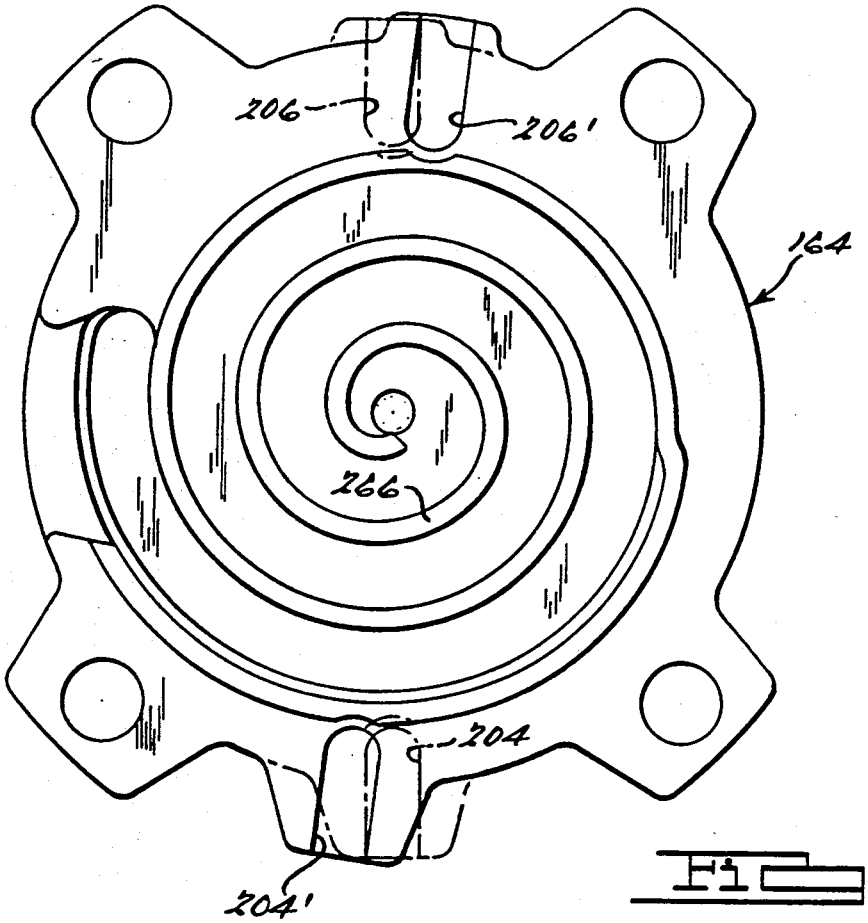
FIG. 27 is a bottom plan view of a modified version of the non-orbiting scroll member of FIG. 22.
Figure 28:
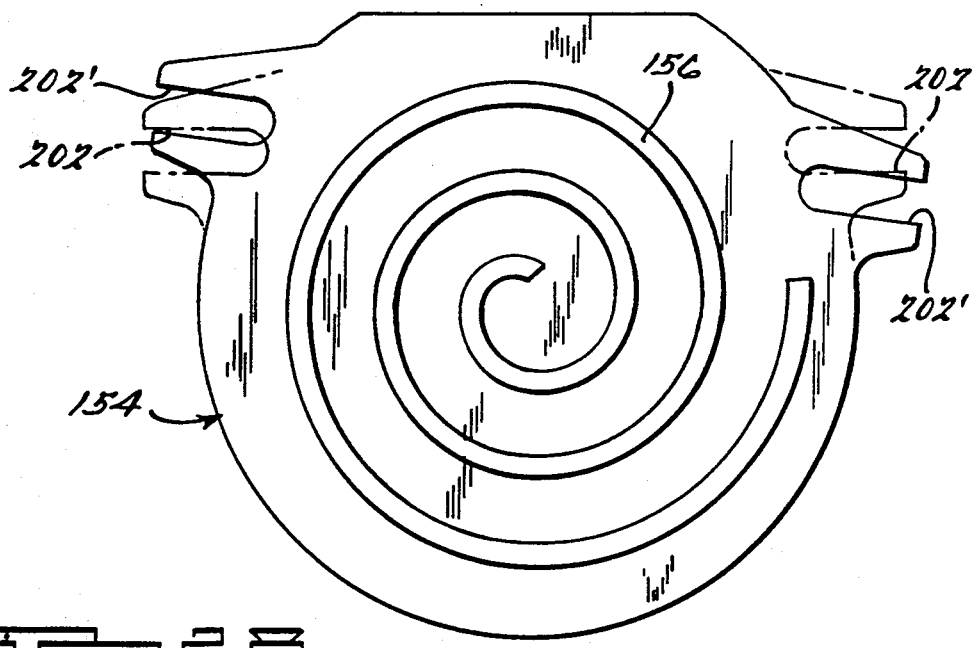
FIG. 28 is a top plan view of a modified version of the orbiting scroll member of FIG. 22.

The convention that applicants' have followed the all of the prior drawing figures is that of viewing the individual wraps and wrap sets as if one were looking downwardly through the fixed or non-orbiting scroll member in FIG. 22. There are a number of ways to mechanically alter the design of the compressor of FIG. 22 to easily provide the swing radius bias sought in accordance with the present invention. For example, a counter clockwise rotation of the Oldham slots 204 and 206 in non-orbiting scroll member 164 (which effectively rotates the orbiting scroll 154 in a counter clockwise direction relative to the non-orbiting scroll 164) will provide the degree of positive $R_{is}$ bias desired. This can be seen with reference to FIG. 27 which views the non-orbiting scroll looking upwardly, wherein the newly located slots are indicated at 204' and 206'. Alternatively, a positive $R_{is}$ bias can also be easily obtained by providing a clockwise rotation of the orbiting scroll slots 202 to the positions shown at 202' in FIG. 28 which is looking downwardly toward the orbiting scroll. This causes the orbiting scroll to rotate counter clockwise with respect to the non-orbiting scroll. In both FIGS. 27 and 28 there is no change made to the Oldham ring, wherein both pairs of keys are disposed on perpendicular lines, respectively.

Figure 29:
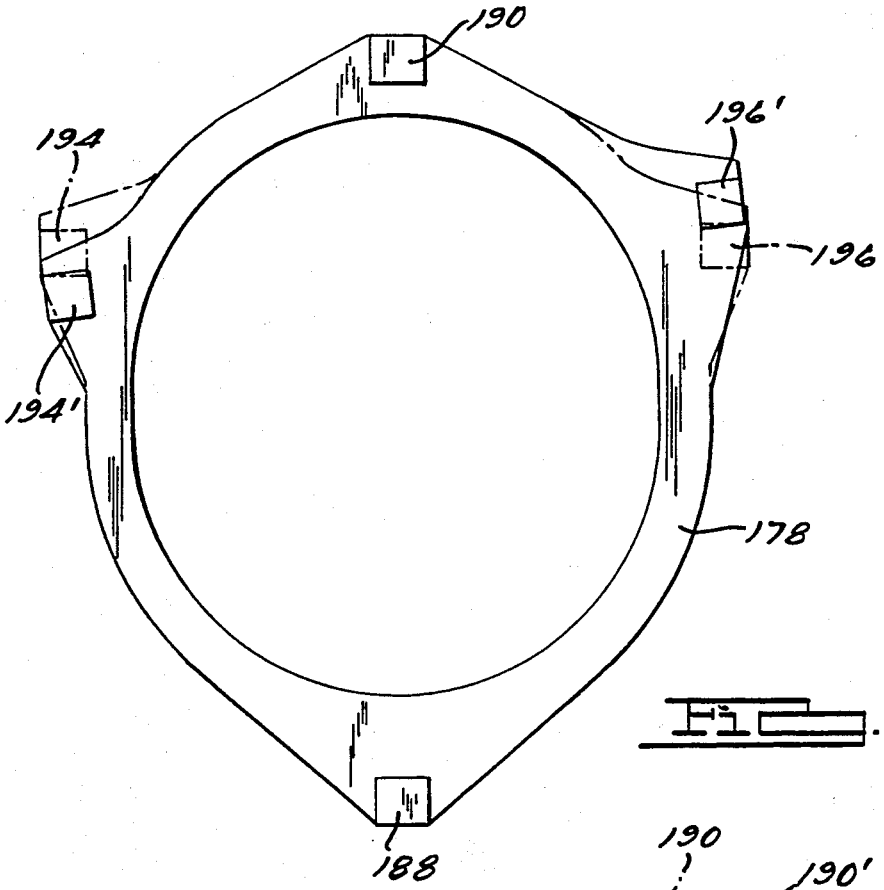
FIGS. 29 and 30 are top plan views of modified versions of the Oldham coupling ring of FIG. 22.
Figure 30:
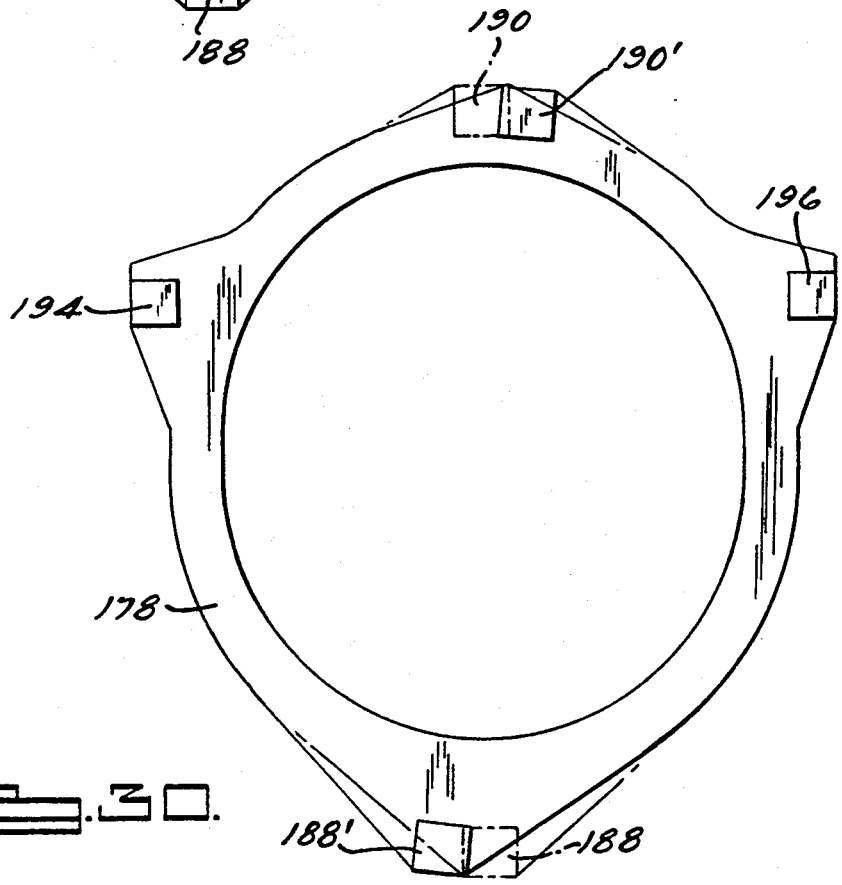

Another way to obtain positve $R_{is}$ bias, without changing either the non-orbiting or orbiting scroll members, is to rotate the orbiting scroll Oldham keys 194 and 196 counter clockwise, as illustrated in FIG. 29. A similar result can be obtained by clockwise rotation the non-orbiting scroll Oldham keys 188 and 190, as illustrated in FIG. 30. In both of these Figures, the prime numbers indicate the new locations of the respective keys.

Not until the present invention was it appreciated that a swing radius bias could be obtained by providing a calculated misalignment of the respective abutment surfaces of the Oldham coupling mechanism. The calculated misalignment of the respective abutment surfaces which create the initial swing radius bias are relatively small in magnitude and thus do not prohibit the operation of the compressor. The misalignment causes the travel of the Oldham coupling to be larger than the scroll travel but it does not prohibit the movement of the misaligned scrolls.

Another Applicable Compressor Design

In FIGS. 31–34 is shown the upper portion of another scroll compressor to which the present invention is applicable. This compressor is more fully disclosed in applicants' assignee's aforesaid '382 patent. The significant difference between this design and one in FIGS. 22–30 is that in this design the orbiting scroll is keyed to the main bearing housing rather than the non-orbiting scroll. With reference to the drawings, the machine generally comprises three major overall units, i.e, a central assembly 310 having within a circular cylindrical steel shell 312, a top assembly 314 and a bottom assembly (not shown) welded to the upper and lower ends of shell 312, respectively, to close and seal same. Shell 312 houses the major components of the machine, generally including an electric motor 31 8 having a stator 320 (with conventional windings 322 and protector 323) press fit within shell 312, a motor rotor 324 secured to crankshaft 328, a compressor body or main bearing housing 330 preferably welded to shell 312 at a plurality of circumferentially spaced locations, as at 332, and supporting an orbiting scroll member 334 having a scroll wrap 335 of a desired flank profile, an upper crankshaft bearing 339 of conventional two-piece bearing construction, a non-orbiting axially compliant scroll member 336 having a scroll wrap 337 of a desired flank profile meashing with wrap 335 in the usual manner, a discharge port 341 in scroll member 336, an Oldham ring 338 disposed between scroll member 334 and body 330 to prevent rotation of scroll member 334, a suction inlet fitting 340 soldered or welded to shell 312, a directed suction assembly 342 for directing suction gas to the compressor inlet, and a lower bearing support bracket (not shown) supporting a lower crankshaft bearing (not shown) in which is journalled the lower end of crankshaft. The lower end of the shell has a sump filled with lubricating oil (not shown).

Upper assembly 314 is a discharge muffler comprising a lower stamped shell closure member 358 welded to the upper end of shell 31 2, as at 360, to close and seal same. Closure member 358 has an upstanding peripheral flange 362 and in its central area defines an axially disposed circular cylinder chamber 366 having a plurality of openings 368 in the wall thereof. An annular gas discharge chamber 372 is defined above member 358 by means of an annular muffler member 374 which is welded at its outer periphery to flange 362, as at 376, and at its inner periphery to the outside wall of cylinder chamber 366, as at 378. Compressed gas from discharge port 341 passes through openings 368 into chamber 372 from which it is normally discharged via a discharge fitting 380. Fluid pressure biasing of the non-orbiting scroll member is achieved in the manner set forth in the aforesaid patent.

Orbiting scroll member 334 comprises an end plate 402 having generally flat parallel upper and lower surfaces and respectively, the latter slidably engaging a flat circular thrust bearing surface 408 on body 330. Thrust bearing surface 408 is lubricated by an annular groove 41 0 which receives oil from passage 394 in crankshaft 328 in the manner described in the aforesaid patent. Integrally depending from scroll member 334 is a hub 418 having an axial bore therein which has rotatively journalled therein the radially compliant drive and its lubrication system, as disclosed in detail in the aforesaid patent. Rotation of crankshaft 328 causes scroll member 334 to move in a circular orbital path.

Figure 31:
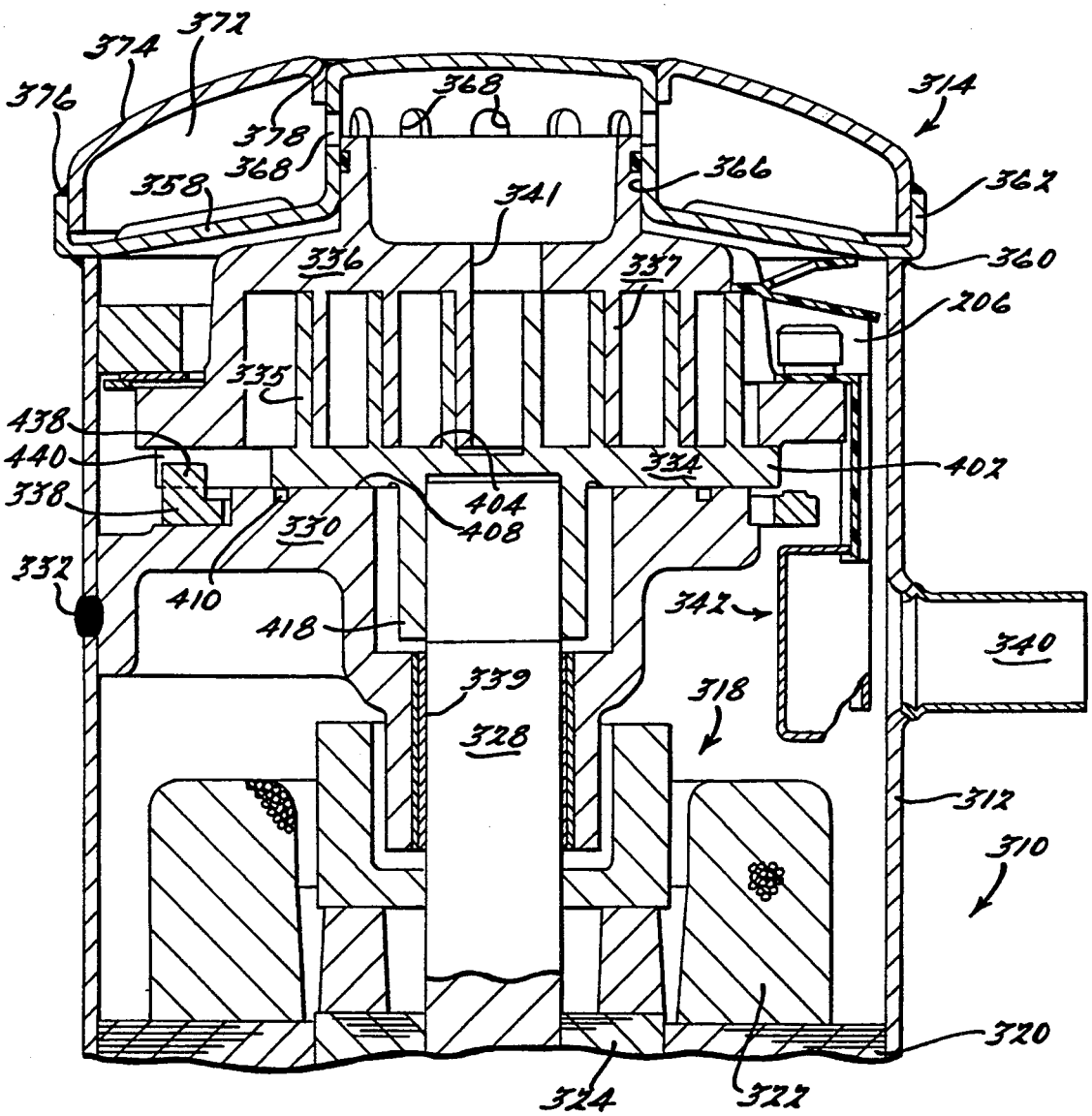
FIG. 31 is a fragmentary vertical sectional view, with certain parts broken away, of another scroll compressor to which the principles of the present invention are applicable.
Figure 32:
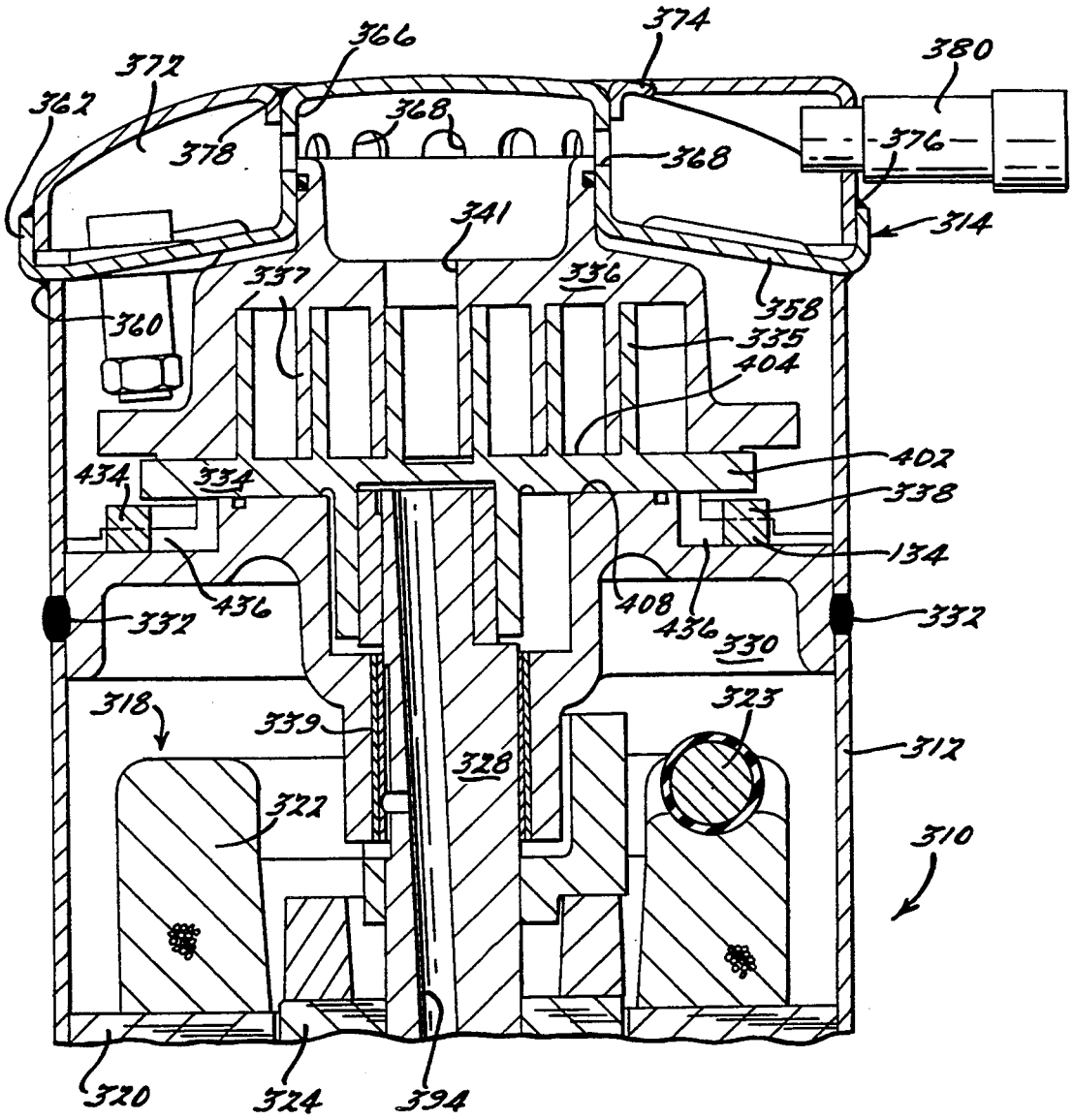
FIG. 32 is is a fragmentary sectional view similar to FIG. 31 but with certain parts slightly rotated.
Figure 33:
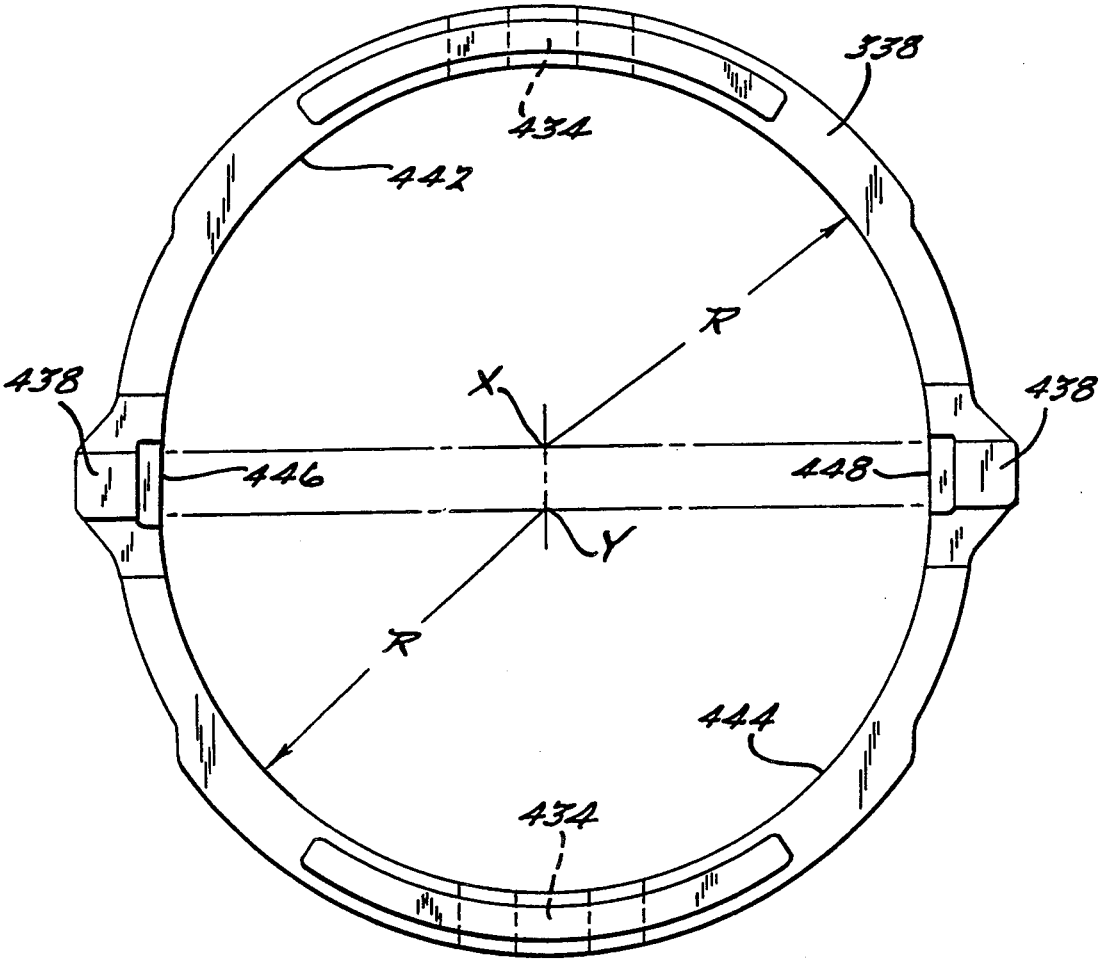
FIG. 33 is a top plan view of the Oldham ring of FIG. 31.
Figure 34:
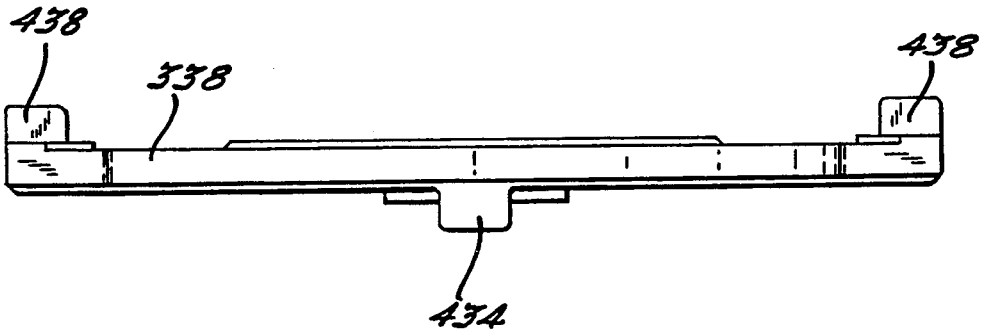
FIG. 34 is a side elevational view of the Oldham ring of FIG. 33.

Rotation of scroll member 334 relative to body 330 and scroll member 336 is prevented by an Oldham coupling, comprising ring 338 which has two downwardly projecting diametrically opposed integral keys 434 slidably disposed in diametrically opposed radial slots 436 in body 330, and nominally at 90 degrees therefrom two upwardly projecting diametrically opposed integral keys 438 slidably disposed in diametrically opposed radial slots 440 in scroll member 334 (one of which is shown in FIG. 31.

Ring 338 is of generally oval or "racetrack" shape of minimum inside dimension to clear the peripheral edge of the thrust bearing. The inside peripheral wall of ring 338, comprises one end 442 of a radius R taken from center x and an opposite end 444 of the same radius R taken from center y, with the intermediate wall portions being substantially straight, as at 446 and 448. Center points x and y are spaced apart a distance equal to twice the orbital radius of scroll member 334 and are located on a line passing through the centers of keys 434 and radial slots 436, and radius R is equal to the radius of thrust bearing surface 408 plus a predetermined minimal clearance.

OTHER APPLICATIONS OF THE INVENTION

In the machine of FIG. 31–34 $dR_{is}$ can be easily achieved in the same manner as in the previous embodiment. For example, slots 440 in the orbiting scroll can be realigned in the manner shown in FIG. 28, or slots 436 in body 330 can be realigned in the manner shown in FIG. 27 with respect to the non-orbiting scroll member. Alternatively (or in addition), keys 438 or keys 434 can be realigned in the manner shown in FIGS. 29 and 30. As before, the direction of angular realignment will control whether the bias is positive or negative.

Figure 35:
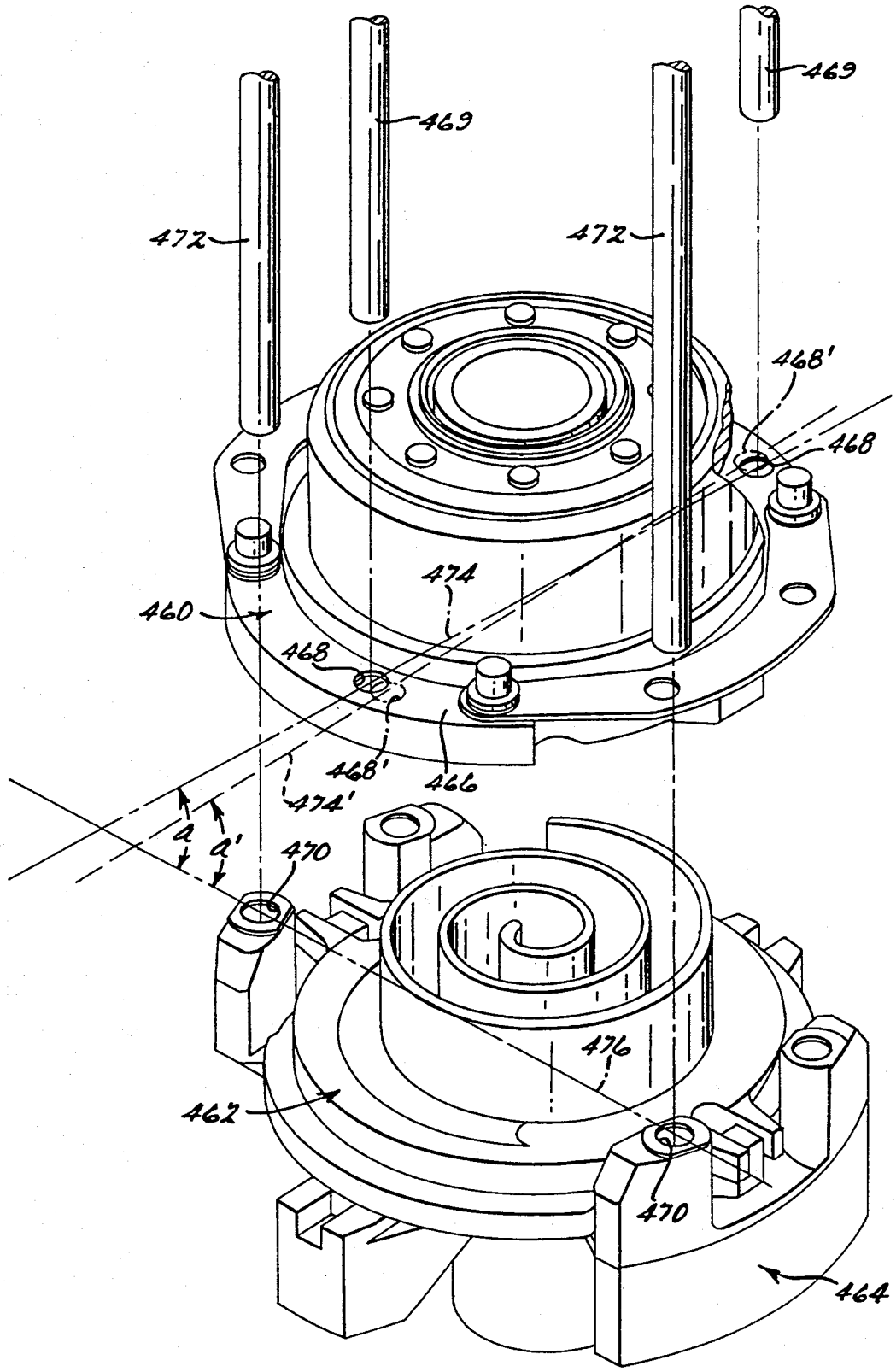
FIG. 35 is an exploded perspective view of a scroll set somewhat similar to that of FIGS. 31–34 showing in an exaggerated manner how to achieve initial swing radius bias through initial alignment of the scroll members during compressor assembly.

Another way to achieve $dR_{is}$ in a machine in which the orbiting scroll member is keyed via the Oldham coupling to the main bearing housing is illustrated in FIG. 35, in which 460 is the non-orbiting scroll member, 462 is the orbiting scroll member and 464 is the main bearing housing. Non-orbiting scroll member 460 has a mounting flange 466 having a pair of accurately positioned axial alignment holes 468 therethrough adapted to receive a first pair of locating pins 469 on a suitable assembly fixture (not shown). Similarly, main bearing housing 464 has a pair of accurately positioned axial mounting and alignment holes 470 adapted, during initial assembly, to receive a second pair of locating pins 472 also forming part of the assembly fixture, thereby establishing a very accurate alignment between the two scroll members as they are assembled. Axis 474 is the axis of holes 468 and axis 476 is the axis of holes 470, and a is the angle therebetween for a nominal compressor. An initial swing radius bias can therefore be easily introduced by slightly increasing or decreasing angle a, such as shown at axis 474' where angle a is increased to a'. This can be accomplished by either realigning holes 468 (for example, as shown at 468') or by realigning holes 470 (not shown) or by realigning both sets of holes, or by realigning one or both pairs of alignment pins 469 and/or 472.

A Further Applicable Compressor Design

The present invention is easily applicable to other types of scroll machines insofar as $dR_{is}$ is concerned. For example, FIGS. 36–38 schematically illustrate a scroll machine which uses a plurality of small cranks to prevent relative rotation of the scroll members, a concept which is well known in the art (the cranks limit relative movement to orbital movement only). Thus, in FIG. 36 is shown in schematic a first scroll member 500 and a second scroll member 502 with the respective wraps intermeshed in the usual manner. Interconnecting each scroll member are a plurality (three shown) of cranks 504, each having one arm 506 rotatively disposed in a suitable bore in scroll member 500 and a second arm 508 in a suitable bore in scroll member 502, with a plurality of counter-bores 510 being provided in scroll member 500 to provide clearance for the throw of each of the cranks. Because at least three such cranks of the same size are used, each being aligned in the same direction (i.e., parallel), relative motion between the scroll members is limited to orbital movement.

FIG. 37 schematically represents a cross-section through crank arms 508, with the solid line sectional portions representing crank arms 508 in the positions they would be in a compressor of nominal design. In the embodiment of FIGS. 36 and 37, $dR_{is}$ may be easily effected by moving each of the crank receiving holes in scroll member 502 the same distance in either a clockwise or a counter clockwise circumferential direction, as shown in phantom at 512 and 514, depending on whether a negative or positive $R_{is}$ bias is desired, as will be readily apparent to one skilled in the art based on the above teachings. Alternatively (or in addition), the holes in scroll member 500 which receive crank arms 506 can be realigned circumferentially in the desired direction in a manner similar to that shown in FIG. 37.

Another crank-type machine is schematically shown in FIG. 38, where the cranks 520 control the movement of the orbiting scroll member 522 relative to a fixed housing member 524 rather than to the non-orbiting scroll (not shown). In this arrangement each crank 520 has one arm 526 rotatably disposed in a suitable hole in orbiting scroll member 522, and the other arm 528 rotatively disposed in a suitable bore in housing 524, the latter also having a plurality of counter-bores 530 to provide clearance for the throw of each of the cranks. Positive and negative $dR_{is}$ can be easily obtained by slightly realigning in a clockwise or counter clockwise circumferential direction the holes which receive either crank arms 526 or crank arms 528, in a manner similar to that shown in FIG. 36. Alternatively, both sets of holes can be realigned.

CONCLUSION

The approaches set forth herein have the following advantages: Flank forces will increase as the compression gas loads decrease (because there is less gas separating force to oppose the relatively constant centrifugal force imposed by the orbiting scroll), thus helping to offset the loss of moment load at these conditions; using the flank forces to increase the moment involves changing the moment arm without changing the frictional losses so there should be no impact on performance; any increase in friction due to lubrication problems will not adversely affect the moment loading because friction has a positive effect, while loss of friction entirely will only reduce about half of the flank load because the flank contact force created by gas loads still exists; minimizing leakage will improve capacity and thus performance (in some embodiments); leakage decreases as the compression gas loads decrease, thus reducing its adverse effect on the moment load at these conditions; no additional problems are introduced if the compressor is run at an "overcompression" condition because leakage forces will work with the friction to increase the flank load; and the approach can be implemented by relatively simple changes in the manufacturing process for an existing scroll machine design.

It is believed that the principles of the present invention apply to other types of scroll machines, such as motors, scroll compressors having dual rotating scroll members as well as scroll machines which use cranks, balls or other devices to prevent relative rotation of the scrolls. Moreover, the fixed scroll need not be truly fixed and can be axially compliant. Furthermore, the invention is believed to be independent of crank angle offset (i.e., the angle of the drive flat on the crank pin) unless it is in a direction and of a magnitude to increase centrifugal force to an amount which will keep the orbiting scroll loaded in all normal operating conditions.

Except as described herein, the machine of the present invention is otherwise nominal or symmetrical in design, aside from the unavoidable but trivial imblances which may occur in the suction and discharge processes. The loading provided by this invention insures that such trivial imbalances will not increase sound level of the type dealt with herein. It is also assumed that the machine is capable of radial compliance in the sense that the orbital drive mechanism will permit flank contact at at least one point.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. A scroll machine having improved sound attenuation, comprising:

(a) first and second scroll members each having a spiral wrap disposed thereon, said scroll members being mounted for relative orbital movement therebetween with said wraps intermeshed with one another;

(b) means for causing one of said scroll members to orbit with respect to the other scroll member so that said wraps create pockets of progressively changing volume;

(c) anti-rotation means for preventing relative rotational movement between said scroll members, said anti-rotation means causing said first and second scroll members to be maintained in a misaligned relationship from the normal angular alignment of a nominal scroll machine by an angular amount providing an initial swing radius bias which results in an additional moment on said scroll members caused by the contact forces between said wraps.

2. A scroll machine as claimed in claim 1 wherein said bias is a positive initial swing radius bias.

3. A scroll machine as claimed in claim 1 wherein said bias is a negative initial swing radius bias.

4. A scroll machine as claimed in claim 1 wherein at least one of said wraps has a profile having a generating radius error compared to that of a nominal scroll machine, wherein said error results in an additional moment on said scroll members caused by the contact forces between said wraps.

5. A scroll machine as claimed in claim 1 wherein said anti-rotation means is an Oldham coupling for preventing relative rotational movement between said first and second scroll members, said Oldham coupling including an annular ring, a first pair of aligned abutment surfaces on said ring operatively associated with a first pair of aligned abutment surfaces on said first scroll member to prevent relative rotation between said coupling and said first scroll member, and a second pair of aligned abutment surfaces on said ring operatively associated with a second pair of aligned abutment surfaces on said second scroll member to prevent relative rotation between said coupling and said second scroll member.

6. A scroll machine as claimed in claim 5, wherein said first pair of abutment surfaces on said ring is aligned with said second pair of abutment surfaces on said ring at an angle which will permit the machine to operate nominally plus a bias angle chosen to provide said initial swing radius bias.

7. A scroll machine as claimed in claim 6 wherein said bias is positive.

8. A scroll machine as claimed in claim 6 wherein said bias is negative.

9. A scroll machine as claimed in claim 5 wherein said first and second pairs of abutment surfaces on said ring are aligned at an angle which would provide nominal operation and wherein said pair of abutment surfaces on said first scroll member are angularly misaligned with respect to the position they would assume in a nominal scroll machine by an amount sufficient to provide said initial swing radius bias.

10. A scroll machine as claimed in claim 9 wherein said misalignment provides a positive bias.

11. A scroll machine as claimed in claim 9 wherein said misalignment provides a negative bias.

12. A scroll machine as claimed in claim 5 wherein said first and second pairs of abutment surfaces on said ring are aligned at an angle which would provide nominal operation and wherein said pair of abutment surfaces on said second scroll member are angularly misaligned with respect to the position they would assume in a nominal scroll machine by an amount sufficient to provide said initial swing radius bias.

13. A scroll machine as claimed in claim 12 wherein said misalignment provides a positive bias.

14. A scroll machine as claimed in claim 12 wherein said misalignment provides a negative bias.

15. A scroll machine as claimed in claim 1 further comprising a fixed housing, said first scroll member being an orbiting scroll member supported by said housing, and wherein said anti-rotation means is an Oldham coupling for preventing relative rotational movement between said first scroll member and said housing, said Oldham coupling including an annular ring, a first pair of aligned abutment surfaces on said ring operatively associated with a first pair of aligned abutment surfaces on said first scroll member to prevent relative rotation between said coupling and said first scroll member, and a second pair of aligned abutment surfaces on said ring operatively associated with a second pair of abutment surfaces on said housing to prevent relative rotation between said coupling and said housing.

16. A scroll machine as claimed in claim 15 wherein said first pair of abutment surfaces on said ring is aligned with said second pair of abutment surfaces on said ring at an angle which will permit the machine to operate nominally plus a bias angle chosen to provide said initial swing radius bias.

17. A scroll machine as claimed in claim 16 wherein said bias is positive.

18. A scroll machine as claimed in claim 16 wherein said bias is negative.

19. A scroll machine as claimed in claim 15 wherein said first and second pairs of abutment surfaces on said ring are aligned at an angle which would provide nominal operation, and wherein said pair of abutment surfaces on said first scroll member are angularly misaligned with respect to the position they would assume in a nominal scroll machine by an amount sufficient to provide said initial swing radius bias.

20. A scroll machine as claimed in claim 19 wherein said misalignment provides a positive bias.

21. A scroll machine as claimed in claim 19 wherein said misalignment provides a negative bias.

22. A scroll machine as claimed in claim 15 wherein said first and second pairs of abutment surfaces on said ring are aligned at an angle which would provide nominal operation, and wherein said pair of abutment surfaces on said housing are angularly misaligned with respect to the position they would assume in a nominal scroll machine by an amount sufficient to provide said initial swing radius bias.

23. A scroll machine as claimed in claim 22 wherein said misalignment provides a positive bias.

24. A scroll machine as claimed in claim 22 wherein said misalignment provides a negative bias.

25. A scroll machine as claimed in claim 1 wherein said anti-rotation means comprises a plurality of cranks for preventing relative rotational movement between said first and second scroll members, each said crank having a first crank arm rotatively disposed in a hole in said first scroll member, and a second crank arm rotatively disposed in a hole in said second scroll member.

26. A scroll machine as claimed in claim 25 wherein said holes in said first scroll member are aligned at an angle which would provide nominal machine operation, and where said holes in said second scroll member are angularly misaligned with respect to the position they would assume in a nominal scroll machine by an amount sufficient to provide said initial swing radius bias.

27. A scroll machine as claimed in claim 26 wherein said misalignment provides a positive bias.

28. A scroll machine as claimed in claim 26 wherein said misalignment provides a negative bias.

29. A scroll machine as claimed in claim 25 wherein at least one of said wraps has a profile having a generating radius error compared to that of a nominal scroll machine.

30. A scroll machine as claimed in claim 1 further comprising a fixed housing, said first scroll member being an orbiting scroll member supported by said housing, and wherein said anti-rotation means comprises a plurality of cranks for preventing relative rotational movement between said first scroll member and said housing, each said crank having a first crank arm rotatively disposed in a hole in said first scroll member, and a second crank arm rotatively disposed in a hole in said housing.

31. A scroll machine as claimed in claim 30 wherein said holes in said first scroll member are aligned at an angle which would provide nominal machine operation, and where said holes in said housing are angularly misaligned with respect to the position they would assume in a nominal scroll machine by an amount sufficient to provide said initial swing radius bias.

32. A scroll machine as claimed in claim 31 wherein said misalignment provides a positive bias.

33. A scroll machine as claimed in claim 31 wherein said misalignment provides a negative bias.

34. A scroll machine as claimed in claim 30 wherein at least one of said wraps has a profile having a generating radius error compared to that of a nominal scroll machine.

35. A scroll machine as claimed in claim 1 further comprising a fixed housing, said second scroll member being a non-orbiting scroll member affixed to said housing, said second scroll member being angularly misaligned relative to said housing with respect to the position it would assume in a nominal scroll machine by an amount sufficient to provide said swing radius bias.

36. A scroll machine as claimed in claim 35 wherein said misalignment provides a positive bias.

37. A scroll machine as claimed in claim 35 wherein said misalignment provides a negative bias.

38. A scroll machine as claimed in claim 35 wherein at least one of said wraps has a profile having a generating radius error compared to that of a nominal scroll machine.

39. An Oldham coupling for a scroll machine having first and second scroll members having first and second intermeshed scroll wraps, respectively, for preventing relative rotational movement between said first and second scroll members, said Oldham coupling comprising: an annular ring, a first pair of aligned abutment surfaces on said ring operatively associated with a first pair of aligned abutment surfaces on said first scroll member to prevent relative rotation between said coupling and said first scroll member, and a second pair of aligned abutment surfaces on said ring operatively associated with a second pair of aligned abutment surfaces on said second scroll member to prevent relative rotation between said coupling and said second scroll member, said first pair of abutment surfaces on said ring being aligned with said second pair of abutment surfaces on said ring at an angle which will permit the machine to operate nominally plus a bias angle chosen to provide an initial swing radius bias which results in an additional moment on said scroll members caused by the contact forces between said wraps.

40. An Oldham coupling as claimed in claim 39 wherein said bias is positive.

41. An Oldham coupling as claimed in claim 39 wherein said bias is negative.

42. A scroll machine as claimed in claim 39 wherein at least one of said wraps has a profile having a generating radius error compared to that of a nominal scroll machine.

43. An Oldham coupling for a scroll machine having an orbiting scroll member and a non-orbiting scroll member, said scroll members having first and second intermeshed scroll wraps, and a fixed housing for supporting said orbiting scroll member, said Oldham coupling being operative to prevent relative rotational movement between said orbiting scroll member and said housing and comprising: an annular ring, a first pair of aligned abutment surfaces on said ring operatively associated with a first pair of aligned abutment surfaces on said orbiting scroll member to prevent relative rotation between said coupling and said orbiting scroll member, and a second pair of aligned abutment surfaces on said ring operatively associated with a second pair of aligned abutment surfaces on said housing to prevent relative rotation between said coupling and said housing, said first pair of abutment surfaces on said ring being aligned with said second pair of abutment surfaces on said ring at an angle which will permit the machine to operate nominally plus a bias angle chosen to provide a swing radius bias which results in an additional moment on said scroll members caused by the contact forces between said wraps.

44. An Oldham coupling as claimed in claim 43 wherein said bias is positive.

45. An Oldham coupling as claimed in claim 43 wherein said bias is negative.

46. A scroll machine as claimed in claim 43 wherein at least one of said wraps has a profile having a generating radius error compared to that of a nominal scroll machine.

47. A method of fabricating a scroll machine having improved sound attenuation wherein the machine comprises first and second scroll members each having a spiral wrap disposed thereon, said scroll members being mounted for relative orbital movement therebetween with said wraps intermeshed with one another to define a scroll set, so that said wraps will create pockets of progressively changing volume in response to said orbital movement, said method comprising the following steps: accurately controlling initial swing radius bias ($dR_{is}$) and generating radius bias ($dR_g$) during fabrication of the respective components of the machine to maintain a targeted relationship between $dR_{is}$ and $dR_g$ which results in an additional moment on the scroll members caused by the contact forces between the wraps during operation of the machine; and assembling the machine in such a way as to maintain the targeted $dR_{is}$ and $dR_g$.

48. A method of fabricating a scroll machine as claimed in claim 47 wherein $dR_g$ is chosen to avoid suction-closing impact.

49. A method of fabricating a scroll machine as claimed in claim 47 wherein $dR_g$ is chosen to provide discharge-opening release.

50. A method of fabricating a scroll machine as claimed in claim 47 wherein $dR_g$ is chosen to increase the moment loading on said wraps.

51. A method of fabricating a scroll machine as claimed in claim 47 wherein $dR_{is}$ is chosen to yield a positive moment loading.

52. A method of fabricating a scroll machine as claimed in claim 47 wherein sufficient positive $dR_{is}$ is provided to yield a positive moment loading and where a negative $dR_g$ is provide in order to reduce any gas leakage between the flanks caused by the positive $dR_{is}$.

53. A method of fabricating a scroll machine as claimed in claim 47 wherein said $dR_{is}$ is positive and targeted at approximately 0.005 to 0.025 mm.

54. A method of fabricating a scroll machine as claimed in claim 47 wherein said $dR_g$ is negative and targeted at approximately 0.000 to 0.0004 mm.

55. A method of fabricating a scroll machine as claimed in claim 54 wherein said $dR_{is}$ is positive and targeted at approximately 0.005 to 0.025 mm.

56. A method of fabricating a scroll machine as claimed in claim 47 wherein said $dR_{is}$ is positive and targeted at approximately 0.015 mm.

57. A method of fabricating a scroll machine as claimed in claim 47 wherein said $dR_g$ is negative and targeted at approximately 0.0002 mm.

58. A method of fabricating a scroll machine as claimed in claim 57 wherein said $dR_{is}$ is positive and targeted at approximately 0.015 mm.

59. A method of fabricating a scroll machine as claimed in claim 47 wherein said $dR_{is}$ is positive and targeted at approximately 0.000 to 0.012 times $R_g$.

60. A method of fabricating a scroll machine as claimed in claim 47 wherein said $dR_{is}$ is positive and targeted at approximately 0.006 times $R_g$.

61. A method of fabricating a scroll machine as claimed in claim 47 wherein said $dR_{is}$ is positive and said $dR_g$ is negative.

62. A method of fabricating a scroll machine as claimed in claim 47 wherein said $dR_{is}$ is negative and said $dR_g$ is positive.

63. A method of fabricating a scroll machine as claimed in claim 47 wherein said wraps define a scroll set and wherein said $dR_g$ includes a first $dR_g$ on an inner portion of said wrap set and a second $dR_g$ on an outer portion of said scroll set.

64. A method of fabricating a scroll machine as claimed in claim 63 wherein said first $dR_g$ is smaller than said second $dR_g$.

65. A method of fabricating a scroll machine as claimed in claim 63 wherein said first $dR_g$ is positive and said second $dR_g$ is negative.

66. A method of fabricating a scroll machine as claimed in claim 65 wherein said first $dR_g$ is smaller than said second $dR_g$.

67. A method of fabricating a scroll machine as claimed in claim 63 wherein said first $dR_g$ and said second $dR_g$ are both positive.

68. A method of fabricating a scroll machine as claimed in claim 63 wherein said scroll set is configured with a single $dR_{is}$ for the entire wrap set length.

69. A method of fabricating a scroll machine as claimed in claim 63 wherein said second $dR_g$ extends to approximately the angular center of the working wrap set.

70. A method of fabricating a scroll machine as claimed in claim 63 wherein said $dR_{is}$ is positive.

71. A method of fabricating a scroll machine as claimed in claim 63 wherein said $dR_{is}$ is negative.

72. A method of fabricated in accordance with the method set forth in claim 47.

73. A method of fabricating a scroll machine having improved sound attenuation wherein the machine comprises first and second scroll members each having a spiral wrap disposed thereon, said scroll members being mounted for relative orbital movement therebetween with said wraps intermeshed with one another to define a scroll set so that said wraps will create pockets of progressively changing volume in response to said orbital movement, said method comprising the following steps: accurately controlling initial swing radius bias ($dR_{is}$) and generating radius bias ($dR_g$) during fabrication of the respective components of the machine to maintain a targeted relationship between $dR_{is}$ and $dR_g$ which will cause said wraps to contact each other only on one side of the geometric center of said scroll set during normal operation of the machine; and assemblying the machine in such a way as to maintain the targeted $dR_{is}$ and $dR_g$.

74. A method of fabricating a scroll machine as claimed in claim 73 wherein $dR_g$ is chosen to avoid suction-closing impact.

75. A method of fabricating a scroll machine as claimed in claim 73 wherein $dR_g$ is chosen to provide discharge-opening release.

76. A method of fabricating a scroll machine as claimed in claim 73 wherein $dR_g$ is chosen to increase the moment loading on said wraps.

77. A method of fabricating a scroll machine as claimed in claim 73 wherein $dR_{is}$ is chosen to yield a positive moment loading.

78. A method of fabricating a scroll machine as claimed in claim 73 wherein sufficient positive $dR_{is}$ is provided to yield a positive moment loading and where a negative $dR_g$ is provided in order to reduce any gas leakage between the flanks caused by the positive $dR_{is}$.

79. A method of fabricating a scroll machine as claimed in claim 73 wherein said $dR_{is}$ is positive and targeted at approximately 0.005 to 0.025 mm.

80. A method of fabricating a scroll machine as claimed in claim 73 wherein said $dR_g$ is negative and targeted at approximately 0.000 to 0.0004 mm.

81. A method of fabricating a scroll machine as claimed in claim 80 wherein said $dR_{is}$ is positive and targeted at approximately 0.005 to 0.025 mm.

82. A method of fabricating a scroll machine as claimed in claim 73 wherein said $dR_{is}$ is positive and targeted at approximately 0.015 mm.

83. A method of fabricating a scroll machine as claimed in claim 73 wherein said $dR_g$ is negative and targeted at approximately 0.0002 mm.

84. A method of fabricating a scroll machine as claimed in claim 83 wherein said $dR_{is}$ is positive and targeted at approximately 0.015 mm.

85. A method of fabricating a scroll machine as claimed in claim 73 wherein said $dR_{is}$ is positive and targeted at approximately 0.000 to 0.012 times $R_g$.

86. A method of fabricating a scroll machine as claimed in claim 73 wherein said $dR_{is}$ is positive and targeted at approximately 0.006 times $R_g$.

87. A method of fabricating a scroll machine as claimed in claim 73 wherein said $dR_{is}$ is positive and said $dR_g$ is negative.

88. A method of fabricating a scroll machine as claimed in claim 73 wherein said $dR_{is}$ is negative and said $dR_g$ is positive.

89. A method of fabricating a scroll machine as claimed in claim 73 wherein said wraps define a scroll set and wherein said $dR_g$ includes a first $dR_g$ on an inner portion of said wrap set and a second $dR_g$ on an outer portion of said scroll set.

90. A method of fabricating a scroll machine as claimed in claim 89 wherein said first $dR_g$ is smaller than said second $dR_g$.

91. A method of fabricating a scroll machine as claimed in claim 89 wherein said first $dR_g$ is positive and said second $dR_g$ is negative.

92. A method of fabricating a scroll machine as claimed in claim 89 wherein said first $dR_g$ is smaller than said second $dR_g$.

93. A method of fabricating a scroll machine as claimed in claim 89 wherein said first $dR_g$ and said second $dR_g$ are both positive.

94. A method of fabricating a scroll machine as claimed in claim 89 wherein said scroll set is configured with a single $dR_{is}$ for the entire wrap set length.

95. A method of fabricating a scroll machine as claimed in claim 89 wherein said second $dR_g$ extends to approximately the angular center of the working wrap set.

96. A method of fabricating a scroll machine as claimed in claim 89 wherein said $dR_{is}$ is positive.

97. A method of fabricating a scroll machine as claimed in claim 89 wherein said $dR_{is}$ is negative.

98. A scroll machine fabricated in accordance with the method set forth in claim 73.

99. A scroll machine having improved sound attenuation, comprising:

(a) first and second scroll members each having a spiral wrap disposed thereon, said scroll members being mounted for relative orbital movement therebetween with said wraps intermeshed with one another to form a scroll set, said scroll set being configured to have an initial swing Radius bias ($dR_{is}$) and a multiple generating radius bias ($dR_g$), including a first $dR_g$ on an inner portion of said scroll set and a second $dR_g$ on an outer portion of said scroll set; and (b) means for causing one of said scroll members to orbit with respect to the other scroll member so that said wraps create pockets of progressively changing volumes.

100. A scroll machine as claimed in claim 99 wherein said first $dR_g$ is smaller than said second $dR_g$.

101. A scroll machine as claimed in claim 99 wherein said first $dR_g$ is positive and said second $dR_g$ is negative.

102. A scroll machine as claimed in claim 101 wherein said first $dR_g$ is smaller than said second $dR_g$.

103. A method of fabricating a scroll machine as claimed in claim 99 wherein said first $dR_g$ and said second $dR_g$ are both positive.

104. A method of fabricating a scroll machine as claimed in claim 99 wherein said $dR_{is}$ is positive.

105. A method of fabricating a scroll machine as claimed in claim 99 wherein said $dR_{is}$ is negative.

106. A scroll machine as claimed in claim 99 wherein said scroll set is configured with a single $dR_{is}$ for the entire wrap set length.

107. A scroll machine as claimed in claim 99 wherein said second $dR_g$ extends to approximately the angular center of the working wrap set.

108. A scroll machine as claimed in claim 99 wherein the transition point between said first and second $dR_g$ is slightly more than one full wrap (360° wrap angle) after suction closing.

109. A method of fabricating a scroll machine having improved sound attenuation wherein the machine comprises first and second scroll members each having a spiral wrap disposed thereon, said scroll members being mounted for relative orbital movement therebetween with said wraps intermeshed with one another to define a scroll set, so that said wraps will create pockets of progressively changing volume in response to said orbital movement, said method comprising the following steps: accurately controlling generating radius bias ($dR_g$) during fabrication of the respective components of the machine to maintain a targeted value of $dR_g$ which results in an additional moment on the scroll members caused by the contact forces between the wraps during operation of the machine; and assemblying the machine in such a way as to maintain the targeted $dR_g$.

110. A scroll machine fabricated in accordance with the method set forth in claim 109.

111. A method of fabricating a scroll machine as claimed in claim 109 wherein said first scroll member is an orbiting scroll member and said second scroll member is a non-orbiting axially compliant scroll member, and further comprising the step of controlling the $dR_g$ of said second scroll member to a targeted value of zero.

112. A method of fabricating a scroll machine having improved sound attenuation wherein the machine comprises first and second scroll members each having a spiral wrap disposed thereon, said scroll members being mounted for relative orbital movement therebetween with said wraps intermeshed with one another to define a scroll set so that said wraps will create pockets of progressively changing volume in response to said orbital movement, said method comprising the following steps: accurately controlling generating radius bias ($dR_g$) during fabrication of the respective components of the machine to maintain a targeted value of $dR_g$ which will cause said wraps to contact each other only on one side of the geometric center of said scroll set during normal operation of the machine; and assemblying the machine in such a way as to maintain the targeted $dR_g$.

113. A scroll machine fabricated in accordance with the method set forth in claim 112.

114. A method of fabricating a scroll machine as claimed in claim 112 wherein said first scroll member is an orbiting scroll member and said second scroll member is a non-orbiting axially compliant scroll member, and further comprising the step of controlling the $dR_g$ of said second scroll member to a targeted value of zero.

115. A scroll machine having improved sound attenuation, comprising:

(a) first and second scroll members each having a spiral wrap disposed thereon, said scroll members being mounted for relative orbital movement therebetween with said wraps intermeshed with one another to form a scroll set, said scroll set being configured to have a $dR_{is}$, and a multiple generating radius bias ($dR_g$), including a first $dR_g$ on an inner portion of said scroll set which results in an additional moment on the scroll members caused by the contact forces between the wraps during operating of the machine and a second $dR_g$ on an outer portion of said scroll set; and (b) means for causing one of said scroll members to orbit with respect to the other scroll member so that said wraps create pockets of progressively changing volumes.

* * * * *

UNITED STATES PATENT AND TRADEMARK OFFICE

CERTIFICATE OF CORRECTION

PATENT NO. : 5,342,184

DATED : August 30, 1994

INVENTOR(S) : Robert J. Comparin et al

It is certified that error appears in the above-indentified patent and that said Letters Patent is hereby corrected as shown below:

Column 4, line 5, delete "is" (second occurrence).

Column 5, line 40, "$_{FCB}$" should be — $F_{CB}$ —.

Column 6, line 23, "Similary" should be — Similarly —.

Column 7, line 8, "by" should be — be —.

Column 9, line 44, "conversely" should be — Conversely —.

Column 10, line 65, "suddently" should be — suddenly—.

Column 12, lines 5 and 6, "compliment" should be — complement —.

Column 15, line 61, "reltively" should be — relatively —.

Column 16, line 26, "memember" should be — member —.

Column 16, line 40, "fo" should be — of —.

Column 17, line 1, "26." should be — 26, —.

Column 18, line 5, "the" should be — in —.

Column 18, line 34, after "rotation" insert — of —.

Column 18, line 66, "31 8" should be — 318 —.

UNITED STATES PATENT AND TRADEMARK OFFICE

CERTIFICATE OF CORRECTION

PATENT NO. : 5,342,184

DATED : August 30, 1994

INVENTOR(S) : Robert J. Comparin et al

It is certified that error appears in the above-indentified patent and that said Letters Patent is hereby corrected as shown below:

Column 19, line 9, "meashing" should be — meshing —.

Column 19, line 22, "31 2" should be — 312 —.

Column 19, line 42, "41 0" should be — 410 —.

Column 19, line 59, after "31" insert — ) —.

Column 20, line 7, "FIG." should be — FIGS. —.

Column 22, line 1, "imblances" should be — imbalances —.

Column 26, lines 10 and 11, "assemblying" should be — assembling —.

Column 26, line 29, "provide" should be — provided —.

Column 27, line 22, "method of" should be — scroll machine —.

Column 27, lines 39 and 40, "assemblying" should be — assembling —.

Column 28, line 35, "89" should be — 91 —.

Column 28, line 60, "Radius" should be — radius —.

Column 28, line 64, after "set" insert — which results in an additional moment on the scroll members caused by the contact forces between the wraps during operation of the machine —.

Column 29, lines 38 and 39, "assemblying" should be — assembling —.

Column 30, lines 17 and 18, "assemblying" should be — assembling —.

UNITED STATES PATENT AND TRADEMARK OFFICE

CERTIFICATE OF CORRECTION

PATENT NO. : 5,342,184

DATED : August 30, 1994

INVENTOR(S) : Robert J. Comparin et al

It is certified that error appears in the above-indentified patent and that said Letters Patent is hereby corrected as shown below:

Column 30, line 35, delete "a $dR_{is}$,".

Column 30, line 35, delete "and".

Column 30, lines 37-40, delete "which results in an additional moment on the scroll members caused by the contact forces between the wraps during operating of the machine".

Column 30, line 41, after "set" insert — which results in an additional moment on the scroll members caused by the contact forces between the wraps during operation of the machine —.

Signed and Sealed this

Fifth Day of December, 1995

*Attest:*

*Attesting Officer*

Bruce Lehman

BRUCE LEHMAN

*Commissioner of Patents and Trademarks*